US006619086B1

(12) United States Patent
Ikeda et al.

(10) Patent No.: US 6,619,086 B1
(45) Date of Patent: Sep. 16, 2003

(54) CONTROL SYSTEM FOR TANDEM ROLLING MILL

(75) Inventors: Hidetoshi Ikeda, Tokyo (JP); Kentaro Yano, Tokyo (JP); Naohiro Kubo, Tokyo (JP)

(73) Assignee: Mitsubishi Denki Kabushiki kaisha, Tokyo (JP)

( * ) Notice: Subject to any disclaimer, the term of this patent is extended or adjusted under 35 U.S.C. 154(b) by 0 days.

(21) Appl. No.: 10/070,458

(22) PCT Filed: Aug. 10, 2000

(86) PCT No.: PCT/JP00/05377

§ 371 (c)(1),
(2), (4) Date: Mar. 7, 2002

(87) PCT Pub. No.: WO02/13984

PCT Pub. Date: Feb. 21, 2002

(51) Int. Cl.[7] ..... B21B 37/48
(52) U.S. Cl. ..... 72/8.6; 72/11.4; 700/152
(58) Field of Search ..... 72/8.6, 11.4, 12.3, 72/205, 365.2; 700/152

(56) References Cited

U.S. PATENT DOCUMENTS

| | | | | |
|---|---|---|---|---|
| 4,307,591 A | * | 12/1981 | Peterson | 72/12.3 |
| 5,660,066 A | * | 8/1997 | Asano et al. | 72/11.4 |
| 5,701,774 A | * | 12/1997 | Imanari et al. | 72/8.6 |

FOREIGN PATENT DOCUMENTS

| | | | | |
|---|---|---|---|---|
| JP | 56-4306 | | 1/1981 | |
| JP | 56-4307 | | 1/1981 | |
| JP | 7-16632 | | 1/1995 | |
| JP | 7-32023 | | 2/1995 | |
| JP | 8-59040 | | 3/1996 | |
| JP | 8-155522 | | 6/1996 | |
| JP | 9-10809 | * | 1/1997 | 72/8.6 |
| JP | 10-94813 | * | 4/1998 | 72/8.6 |
| JP | 2000-237812 | * | 9/2000 | 72/8.6 |

OTHER PUBLICATIONS

Manabe, Shinji; "Simple Interpretation of Various Motion Control", *The Transactions of the Inst. of Elec. Engineers of Japan*, vol. 120–D, p. 609, (Apr. 2000).
"PID Control", Japan (Jul. 1992).
"Looper Multivariable Control With Disturbance Observer For Hot Strip Finishing Mill", The Institute of Electrical Engineering Papers, vol. 116, No. 10, pp. 1111–1118.
"Application of Hot Strip Mill To Looper Control", The Society of Instrument and Control Engineers, pp. 66=79.

* cited by examiner

*Primary Examiner*—Ed Tolan
(74) *Attorney, Agent, or Firm*—Leydig, Voit & Mayer, Ltd.

(57) ABSTRACT

In a tandem rolling mill control system, an arithmetic operation on a looper torque command is adopted so that a signal obtained by integrating a looper angle deviation is not contained as a component, and a looper speed controller performs an arithmetic operation with a sampling period at a higher speed than a looper angle controller.

11 Claims, 13 Drawing Sheets

CONTROL SYSTEM FOR TANDEM ROLLING MILL

TECHNICAL FIELD

The present invention relates to a control system for a tandem rolling mill for rolling a steel strip or the like.

BACKGROUND ART

A tandem rolling equipment comprises a tandem rolling mill in which rolls are rotated at each of a plurality of mill stands disposed successively to feed and roll a strip (rolling material). In the tandem rolling mill for performing such rolling, a feeding shape restricting mechanism called looper is disposed between the mill stands, for such a control that the strip maintains a loop (curve) with a predetermined length between the stands and maintains a desired tension, whereby quality of thickness of strip and width of strip is secured and stable operation is provided.

FIG. 1 is a general constitutional view of a major part of a tandem rolling mill, and FIG. 2 is a block diagram of a control system for a tandem rolling mill using a first prior art described in "Application of H∞ Control to Actual Plant" (The Society of Instrument and Control Engineers) pp. 70–73. In FIG. 1, numeral 1 denotes a tandem rolling mill, 21 denotes a strip which is a rolling material, 22 denotes a former-stage mill stand, 23 denotes a latter-stage mill stand, 24 denotes a mill motor, 25 denotes a looper, 26 denotes a looper motor, 27 denotes a tension detector for detecting the tension of the strip 21, and numeral 28 denotes a looper angle detector for detecting the rotating angle and rotating speed of the looper 25. The control system in FIG. 1 is in a general representation without any symbol, because its constitution differs according to the contents of the applied technique, namely, whether the prior art or an embodiment of the present invention. In addition, the tension detector 27 and the looper angle detector 28 are shown within the box of dotted line indicating the tandem rolling mill 1 for easy recognition, but in actual classification, they belong to the components of the control system. In FIG. 2, numeral 20 denotes a control system according to the prior art, 2 denotes a mill speed controller, 3 denotes a looper torque controller, 5 denotes a tension setting torque arithmetic unit, and 6 denotes a looper angle controller.

Next, action or operation will be described.

In the tandem rolling mill 1, rolls are driven to rotate by the mill motor 24 while making a draft at each of the mill stands 22, 23, here the former-stage mill stand 22, and the strip 21 is rolled by feeding out the strip 21. The looper 25 driven by the looper motor 26 as well as attendant mechanisms is disposed between the mill stands 22 and 23, and the looper 25 is brought into contact with the strip 21 drivingly fed by the mill motor 24, whereby the feeding shape of the strip 21 is restricted. On the other hand, in the control system 20, the mill speed controller 2 controls so as to make the speed of the mill motor 24 coincide with a mill speed command vr, and the looper torque controller 3 controls so as to make the torque of the looper motor 26 coincide with a torque command qr. Namely, the control system 20 appropriately calculates the mill speed command vr and the looper torque command qr, and controls so that the strip 21 forms a predetermined loop (curve) between the mill stands, namely, the angle of the looper 25 has a predetermined value, while giving a predetermined tension to the strip 21.

While a constitution in which the mill speed of the former-stage mill stand 22 is controlled in order to control the tension σ of the strip 21 between the mill stands 22 and 23 and the angle θ of the looper 25 has been presented as an example in the above description, the object of control of the mill speed is not limited to the former-stage mill stand 22, and may be the latter-stage mill stand 23.

The first prior art applied to the control system 20 is a system which has been used most generally for a long time, and, although it has not a specially excellent tension control performance, it promises a simple and easily usable control system. The control system 20 is externally supplied with a tension command σr and a looper angle command θr, and is supplied with a looper angle θ detected by the looper angle detector 28. The tension setting torque arithmetic unit 5, in the condition where the tension σ of the strip 21 is steadily conformed to the tension command σr, based on the tension command σr, calculates in a feed-forward manner a torque of the looper motor 26 for the looper 25 to support the strip 21, and outputs the calculated result as a tension setting torque qs. The tension setting torque qs is inputted as a torque command qr to the looper torque controller 3, which performs such a control as to make the torque of the looper motor 26 coincide with the torque command qr. The looper angle controller 6 is supplied with an angle deviation θe which is the difference between the looper angle command θr and the looper angle θ, and calculates the sum of a signal obtained by multiplying the angle deviation θe by an angle proportional gain Cp and a signal obtained by integrating the angle deviation θe and multiplying the integrated value by an angle integral gain Ci. Namely, a PI (proportional integral) arithmetic operation is conducted so that the looper angle θ does not have a steady deviation, and outputs the result of the arithmetic operation as a mill speed command vr. The mill speed controller 2 performs such a control as to make the mill speed coincide with the mill speed command vr.

Thus, the control system 20 generates a tension setting torque qs such that the strip 21 with a tension σ conforming to the tension command σe is steadily supported by the looper 25 in a balanced manner; in addition, under variations in the speed of the strip 21 generated by variations in the draft at the former-stage mill stand 22 and the latter-stage mill stand 23 or the like, the control system 20 corrects the mill speed command vr so that the looper angle θ coincides with the looper angle command θr, namely, the length of the loop between the former-stage mill stand 22 and the latter-stage mill stand 23 becomes constant. In this manner, the looper angle θ and the tension σ are controlled with the looper angle command θr and the tension command σr as target values. Furthermore, the control system 20 in this type does not necessarily need the tension detector 27, and feed-back control is conducted by only the looper angle controller 6, so that operation can be continued by only applying easy adjustments to a one-loop control system based on the looper angle controller 6.

However, the simplicity of a control system and the quality of control performance are opposed to each other in many cases. The characteristics of the tandem rolling mill 1 are basically governed by resonance characteristics of a spring inertia system consisting of the elasticity of the strip 21 and the inertia of the looper 25; therefore, the prior art control system 20 in which the tension σ is not feedback controlled has the problem that the control system becomes instable when the gain of the looper angle controller 6 is raised, and it is difficult to control the tension σ and the angle θ with high accuracy.

Next, FIG. 3 shows the constitution of a control system for a tandem rolling mill according to a second prior art described in "Application of H∞ Control to Actual Plant" (The Society of Instrument and Control Engineers) pp. 77–79. The constitution of the tandem rolling mill 1 which is the object of control is as shown in FIG. 1. Numeral 30 denotes a control system according to the second prior art, 201 denotes a looper angle controller, 202 denotes a tension controller, 203 denotes a noninterference controller having coefficient units H12 and H21, and 204 denotes a looper speed controller. The second prior art is characterized by noninterference control, and a large difference from the first prior art lies in that, based on the tension σ detected by the tension detector 27, the mill motor 24 controls the tension σ while the looper motor 26 controls the looper angle θ in a separate manner.

Next, the action or operation of the control system 30 will be described. First, the looper angle controller 201 supplied with a looper angle deviation θe which is the deviation between a looper angle command θr and the looper angle θ outputs a signal obtained by PI arithmetic operation such that the looper angle θ does not have a steady deviation. On the other hand, the tension controller 202 supplied with a tension deviation σe which is the deviation between a tension command σr and the tension σ outputs a signal obtained by PI arithmetic operation such that the tension σ does not have a steady deviation. The noninterference controller 203 inputs a sum signal of a signal obtained by multiplying the output of the tension controller 202 by −1 and a signal obtained by multiplying the output of the looper angle controller 201 by a constant h12 at the coefficient unit H12 to the mill speed controller 2 as a mill speed command vr, and inputs a sum signal of the output of the looper angle controller 201 and a signal obtained by multiplying the output of the tension controller 202 by a constant h21 at the coefficient unit H21 to the looper speed controller 204 as a looper speed command ωr. The looper speed controller 204 calculates a looper torque command qr so as to make the looper speed ω detected by the looper angle detector 28 coincide with a looper speed command ωr, and inputs the looper torque command qr to the looper torque controller 3, which controls so as to make the torque generated at the looper motor 26 coincide with the lopper torque command qr.

Here, the looper speed controller 204 is composed of a computer different from those of the looper angle controller 201, the tension controller 202 and the noninterference controller 203, and is ordinarily composed of a computer in a motor drive device similarly to the looper torque controller 3. Besides, the arithmetic operation by the computer in the motor drive device is performed with a sampling period at a higher speed than the arithmetic operations by the looper angle controller 201, the tension controller 202 and the noninterference controller 203. The looper speed controller 204 performs a control including an integral feedback so that the looper speed ω conforms to the looper speed command ωr even when a steady torque is externally exerted on the looper motor 26, and, for example, calculates the looper speed command qr by a PI arithmetic operation with the deviation between the looper speed command or and the looper speed ω as an input.

The control system 30 using the second prior art is so configured that the tension σ is controlled by the mill motor 24 while the looper angle θ is controlled by the looper motor 26, and performs such actions that a steady value of the tension σ and a steady value of the looper angle θ are controlled respectively by the mill motor 24 and the looper motor 26. Therefore, there is a characteristic feature that a signal component obtained by integrating the tension deviation σe is added to the mill speed command vr by the action of the tension controller 202 performing a PI arithmetic operation, and a signal component obtained by integrating the looper angle deviation θe is added to the looper torque command qr by the actions of the looper angle controller 201 and the looper speed controller 204. Incidentally, even where the looper angle controller 201 does not perform the PI arithmetic operation but performs only a proportional arithmetic operation, if the looper speed controller 204 performs the PI arithmetic operation, a proportional component of the looper angle deviation θe is added to the looper speed command ωr, and, further, a component obtained by integrating the looper speed command ωr by the PI arithmetic operation of the looper speed controller 203 is added to the looper torque command qr, so that a signal component obtained by integrating the looper angle deviation θe is added to the looper torque command qr, and the steady value of the looper angle θ is controlled by the looper motor 26, in the same manner as above.

In addition, while the noninterference controller 203 is used for obviating the mutual interference between the control of the tension σ by the mill motor 24 and the control of the looper angle θ by the looper motor 26, a signal component obtained by integrating the tension deviation σe is added to the mill speed command vr, and a signal component obtained by integrating the looper angle deviation θe is added to the looper torque command qr, as described above, whereby the steady value of the tension σ is controlled by the mill motor 24, and the steady value of the looper angle θ is controlled by the looper motor 26, in the same manner as above.

Since the control system 30 according to the second prior art acts in the manner described above, the steady value of the looper angle θ is controlled by the looper motor 26 irrespectively of the length of the loop of the strip 21 between the mill stands. Therefore, where proportional gains and integral gains of both of the looper angle controller 201 and the tension controller 202 are not appropriately set in a stroke, there arises the problem that the looper 25 might be separated from the strip 21, and adjustments at the time of starting operation, particularly, are difficult.

In addition, although the noninterference controller 203 is used, perfect noninterference between the control of the tension σ and the control of the looper angle θ is impossible. In particular where control gains of the tension controller 202 and the looper angle controller 201 are small, the control of the tension σ and the control of the looper angle θ may interfere with each other to make the control system instable, and it is difficult to adjust the control system in view of this problem. Further, where control gains of the tension controller 202 and the looper angle controller 201 are set sufficiently large, the looper angle θ is fixed by the action of the looper angle controller 201, so that the control of the tension σ is conducted by only the mill motor 24; thus, the looper 25 cannot be actively utilized for the control of the tension σ, and, therefore, it is impossible to enhance the accuracy of tension control.

Next, FIG. 4 shows the constitution of a control system according to a third prior art described in The Institute of Electrical Engineers Papers C, Vol. 116, No. 10, pp. 1111–1118, and Japanese Patent Laid-open No. 8-155522 (1996). In FIG. 4, the same symbols as those in FIG. 2 denote the same portions, and the description thereof is omitted. Symbol 40 denotes a control system according to the third prior art, and 205 denotes a multi-variable proportional controller. The third prior art is the first prior art plus the multi-variable proportional controller 205.

Next, the action of the control system 40 will be described. First, in the same manner as the control system 20 according to the first prior art, a looper angle controller 6 is supplied with a looper angle deviation θe and outputs a signal obtained by a PI arithmetic operation, and a tension setting torque arithmetic unit 5 calculates a tension setting torque qs based on a tension command σr. The multi-variable proportional controller 205 is supplied with a variational tension Δa which is a variation of tension σ on the basis of a tension command σr and with a looper speed ω, and outputs a sum signal vh of a signal obtained by multiplying the variational tension Δσ by a set constant h22 and a signal obtained by multiplying the looper speed ω by a set constant h21, and a sum signal qh of a signal obtained by multiplying the variational tension Δσ by a set constant h12 and a signal obtained by multiplying the looper speed ω by a set constant h11. Subsequently, a sum signal of the output of the looper angle controller 6 and a signal obtained by multiplying the output vh of the multi-variable proportional controller 205 by −1 is inputted as a mill speed command vr to a mill speed controller 2, and a sum signal of the tension setting torque qs and a signal obtained by multiplying the output qh of the multi-variable proportional controller 205 by −1 is inputted as a looper torque command qr to the looper torque controller 3.

Here, in the control system 40, the proportional gain from the tension σ to the looper torque qr is h12 as described above, and determination of the proportional gain h12 is conducted so that the looper angle θ does not diverge to infinity when the multi-variable proportional controller 205 is operated without operating the looper angle controller 6, namely, on the condition that the variation of the tension σ of the strip 21 in the tandem rolling mill 1 cancels the variation of torque given to the looper 25. Therefore, h12 has a negative sign, and acts so as to increase the looper torque command qr as the tension σ increases. The proportional gain h12 is so set that the variation of the looper angle θ is smaller than the variation of the tension σ under the effect thereof.

As is clear also from the block arrangement, the control system 40 has a structure obtained by only adding the multi-variable proportional controller 205 composed of four proportional gain elements to the first prior art capable of operating the rolling equipment most easily, namely, a one-loop control by use of the looper angle controller 6. Therefore, it suffices to adjust by adding the gains one by one to the one-loop control by the looper angle controller 6, and the adjustment is easier than that in the second prior art, which can be well evaluated.

However, when all the above arithmetic operations are conducted with the same sampling period, the arithmetic operations take time so that the sampling period is long (ordinarily several tens of msec). The long sampling period means that dead time is not negligible, the response characteristics of the control system as a whole are lowered, and, the accuracy of control of the tension σ cannot be sufficiently enhanced accordingly. In addition, the proportional gain h12 from the tension σ to the looper torque command qr has a sign so selected that the looper torque command qr increases as the tension σ increases, and, therefore, actions are so set as not to increase the looper angle θ as much as possible under the variation of the tension σ. As a result, the looper 25 cannot be actively utilized for a control for suppressing the variation of the tension σ, and the control of the tension σ is conducted by only the mill motor 24, so that the accuracy of control of the tension σ has a limitation, and it is difficult to sufficiently enhance the accuracy.

Thus, the first to third prior arts have the problem that the adjustment of the control system is difficult or that the adjustment is easy but it is difficult to sufficiently enhance the accuracy of control.

The present invention is for solving the above-mentioned problems, and it is an object of the invention to realize a tension control with easy adjustment and high accuracy.

DISCLOSURE OF THE INVENTION

A control system for a tandem rolling mill according to the present invention is applied to a tandem rolling mill for continuously rolling a rolling material by bringing a looper driven to rotate by a looper motor into contact with the rolling material drivingly fed by a mill motor so as to restrict the feeding shape of the rolling material, and includes a looper torque controller provided with a torque command for controlling the torque of the looper motor, and a mill speed controller provided with a mill speed command for controlling the speed of the mill motor, wherein the control system comprises a looper angle controller for performing a control arithmetic operation on a looper angle deviation which is a deviation of looper angle from an externally inputted looper angle command and giving the result of the arithmetic operation to the mill speed controller as a mill speed command; and a looper speed controller operating at an arithmetic operation speed higher than that of the looper angle controller, for performing a control arithmetic operation on a looper speed deviation which is a deviation of looper speed from an externally inputted looper speed command, and giving the result of the arithmetic operation to the looper torque controller as a torque command utterly irrelevant to the output of the looper angle controller.

With this configuration, the result of arithmetic operation obtained by a control arithmetic operation performed on a looper speed deviation by the looper speed controller is supplied to the looper torque controller as a torque command utterly irrelevant to the output of the looper angle controller, and a component obtained by integrating a looper angle deviation is not contained in the torque command outputted from the looper speed controller, so that a steady value of looper angle is not controlled separately from a steady value of tension, whereby a control with high accuracy can be made by a simple adjustment on the basis of a one-loop control by the looper angle controller. Further, a variation in looper speed is compensated for by the looper speed controller at an arithmetic operation speed higher than that of the looper angle controller, so that it is possible to reduce the dead time of the control system arising from the length of arithmetic operation period, to control the speed of the looper motor with a sufficient instant response characteristic, and to largely enhance the quality of rolling material tension control, looper angle control and looper speed control.

The control system for the tandem rolling mill according to the present invention is such that the looper speed controller comprises a looper speed proportional controller for proportionally multiplying the looper speed deviation and adding the product to a looper torque command calculated based on a tension command that is a tension target value for the rolling material.

By this, enlarging the proportional gain of the looper speed proportional controller means a proportional compensation of variations in the looper speed by a looper torque command, and the variations in the looper speed due to variations in the torque externally exerted on the looper and the looper motor is controlled. In addition, the feedback control of the looper speed in the looper speed controller is a proportional control, which is irrelevant to integral control containing a time term, so that the looper speed will not become 0 to cause stoppage unless the tension deviation is not 0. Therefore, the variation of the looper angle is not excessively suppressed, as contrasted to the case where the looper speed controller performs integral control also, so that there is little risk that the looper is separated from the rolling material to generate a substantial uncontrollable period. Thus, a stable operation with high quality can be achieved.

The control system for the tandem rolling mill according to the present invention comprises a tension intersection proportional controller for proportionally multiplying a tension deviation which is a deviation of tension from a tension command, and adding the product to the looper speed command.

By this, the tension intersection proportional controller performs such an arithmetic operation as to decrease the looper torque command as the tension increases, and the variation in the tension can be compensated for by actively operating the looper with fast response. As compared with the prior art not using the looper speed controller, the variation direction of the looper angle relative to the tension is the same; however, the variation of tension can be suppressed largely as much as the looper is swiftly operated by the looper speed controller as if the inertia of the looper were reduced. Further, the variation width of the looper angle will not be excessively enlarged because it is suppressed by the operation of the looper angle controller. In addition, since the response of the looper speed relative to the variation in tension is increased, it is possible to set the response characteristic of the looper angle controller to be high, to enhance the response characteristic of the control system as a whole, and to secure a stable operation through enhancing the accuracy of the looper angle control and tension control.

The control system for the tandem rolling mill according to the present invention comprises a tension proportional controller for proportionally multiplying a tension deviation that is a deviation of tension from a tension command, and causing the product to be a subtraction input for said mill speed command.

By this, tension variation can be proportionally compensated for with a mill speed command according to the proportional gain of the tension proportional controller; as a result of the proportional compensation, the tension variation is suppressed, whereby a vibration damping effect of the control system is enhanced, and a stable operation can be more rigidly secured.

The control system for the tandem rolling mill according to the present invention is such that the tension proportional controller comprises a computer operating at an arithmetic operation speed higher than that of the looper angle controller.

By this, of the governing elements of the innermost control loop in the entire control system, the looper speed controller as well as the tension proportional controller can be made to perform high-speed arithmetic operations. Since the innermost control loop in the entire control system required of the fastest response is enhanced in speed, the response of the entire control system can be enhanced in speed, the dead time of the control system due to the length of arithmetic operation periods can be reduced. In addition, the looper motor is controlled in speed with a sufficient instant response characteristic, whereby the quality of control of the entire control system can be enhanced.

The control system for the tandem rolling mill according to the present invention comprises a tension integral controller for performing an integrating arithmetic operation on a tension deviation which is a deviation of tension from a tension command, and adding the result of the arithmetic operation to a tension setting torque.

By this, even where an offset error is steadily generated between a tension steadily balanced by a tension setting torque calculated by a tension setting torque arithmetic unit and a steady value of tension detected by a tension detector due to detection and arithmetic operation errors or the like, generation of the steady offset error can be prohibited by the integral arithmetic operation of the tension integral controller, so that a tension control with higher accuracy can be achieved. In addition, since an integrated value of tension deviation is not added to the mill speed command but is added only to the looper torque command, there is no need to add a control loop for adding an integral component of the looper angle deviation to the looper torque command. Furthermore, since compensation of the offset error does not require an instant response characteristic, a tension integral gain may have a small value. Therefore, the fear that the dynamic characteristics of the entire control system would be deteriorated due to the provision of the tension integral controller is needless, and the tension control performance is enhanced by the addition of a minimum number of control loops, whereby stability and quality of operation can be enhanced.

The control system for the tandem rolling mill according to the present invention is such that the looper speed command externally inputted to the looper speed controller is fixed at zero, and a value obtained by multiplying the looper speed by a negative constant is set as a torque command in the looper torque controller.

By this, the looper speed controller does not receive a looper speed command according to tension deviation, and performs a control action under the condition where the looper speed command is replaced with 0 irrespectively of tension. The innermost control loop is only a control loop for feeding back the looper speed to the looper torque command, and a control loop for feeding back the tension to the mill speed command may be absent. Therefore, although a high-speed response characteristic is somewhat poor, quick response to deviations can be secured by an arithmetic operation at a higher speed than the looper angle controller, whereby response of the entire control system can be enhanced in speed, and the accuracy of control of tension can be enhanced.

The control system for the tandem rolling mill according to the present invention comprises a looper speed intersection proportional controller for proportionally multiplying the looper speed, and causing the product to be a subtraction input for the mill speed command.

By this, in the case where it is desired to further reduce the variations in the looper angle, though difficulty of adjustment increases as much as the adjustment gain increases, the effect of actively using the looper for tension control is weakened, the variation of looper angle is further reduced, and the ratio of using the mill motor and the looper motor for tension control is adjusted, whereby optimum control can be realized.

The control system for the tandem rolling mill according to the present invention comprises a looper angle proportional controller for proportionally multiplying the looper angle deviation which is an input to the looper angle controller, and adding the product to the looper speed command which is an input to the looper speed controller.

By this, where a looper angle proportional control gain is set at a small appropriate value, the response of tension deviation is once swung largely to the negative side and can then be stabilized without swinging to the positive side, whereby a transient variation suppressing type tension control can be realized. In addition, since a signal component obtained by integrating looper angle deviation is not added, a steady value of tension produces an effect on a steady value of looper angle in the same manner as before. Since the steady value of the looper angle and the steady value of tension are not controlled separately from each other, the accuracy of control of tension can be enhanced by an easy adjustment of adding proportional control loops one by one to a one-loop control system, in a supplementary manner, on the basis of the looper angle controller.

The control system for the tandem rolling mill according to the present invention is such that the looper speed controller comprises a looper speed proportional controller for proportionally multiplying the looper speed deviation by a looper speed gain, and the looper speed proportional controller is given a looper speed command including a value obtained by dividing by the looper speed gain a tension setting torque calculated based on a tension command which is a tension target value for the rolling material.

By this, a tension command which is a tension target value for the rolling material is not added at the output stage of the looper speed proportional controller, and a looper speed command including a value obtained by dividing a tension command by the looper speed gain is given on the former stage of the looper speed controller, so that, substantially, the looper speed gain and the reciprocal thereof cancel each other and a tension command with a gain of 1 is added to the output of the looper speed proportional controller, thereby contributing to an increase in processing speed of the looper speed controller in which one adding process is omitted. In addition, since the looper speed controller performs only a proportional control, the variations in the looper angle are not excessively suppressed. Further, since the looper speed controller does not perform an arithmetic operation of a time function, it is easy to externally set a steady looper torque command.

The control system for the tandem rolling mill according to the present invention is such that the looper speed controller comprises a looper speed proportional-integral controller for performing a proportional-integral arithmetic operation on the looper speed deviation, and adding the result of the arithmetic operation to a looper torque command calculated based on a tension command which is a tension target value for the rolling material.

By this, the looper speed controller performs an integral action in addition to a proportional action, whereby a value obtained by integrating the tension deviation is included in the looper torque command, and the steady value of the looper torque command can be set at such a value that a steady deviation of tension is not generated.

BEST MODES FOR CARRYING OUT THE INVENTION

Hereinafter, in order to explain the present invention in detail, the best modes for carrying out the invention will be described referring to the attached drawings.

Embodiment 1

Figure 5:
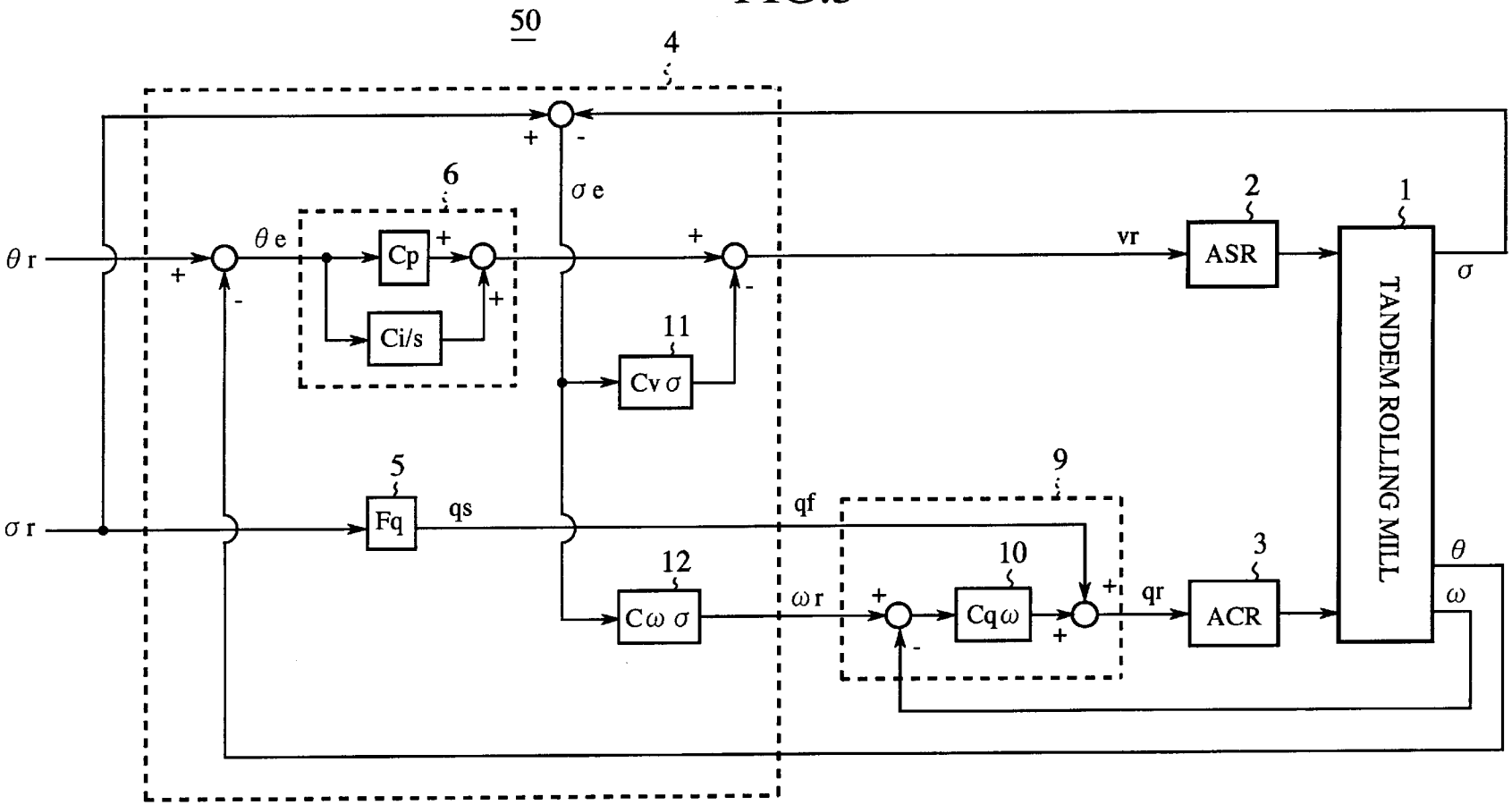
FIG. 5 is a block diagram of a control system for a tandem rolling mill according to Embodiment 1 of the present invention.

FIG. 5 is a block diagram of a control system for a tandem rolling mill according to Embodiment 1 of the present invention. In the figure, numeral 1 denotes a tandem rolling mill of which a major part is schematically shown, 2 denotes a mill speed controller, 3 denotes a looper torque controller, 4 denotes a low-speed arithmetic unit, 5 denotes a tension setting torque arithmetic unit, 6 denotes a looper angle controller, 9 denotes a looper speed controller, 10 denotes a looper speed proportional controller, 11 denotes a tension proportional controller, 12 denotes a tension intersection proportional controller, and 50 denotes a control system. As has been described referring to FIG. 1, a tension detector 27 and a looper angle detector 28 are constituent elements of the control system 50.

Next, action or operation will be described.

Figure 1:
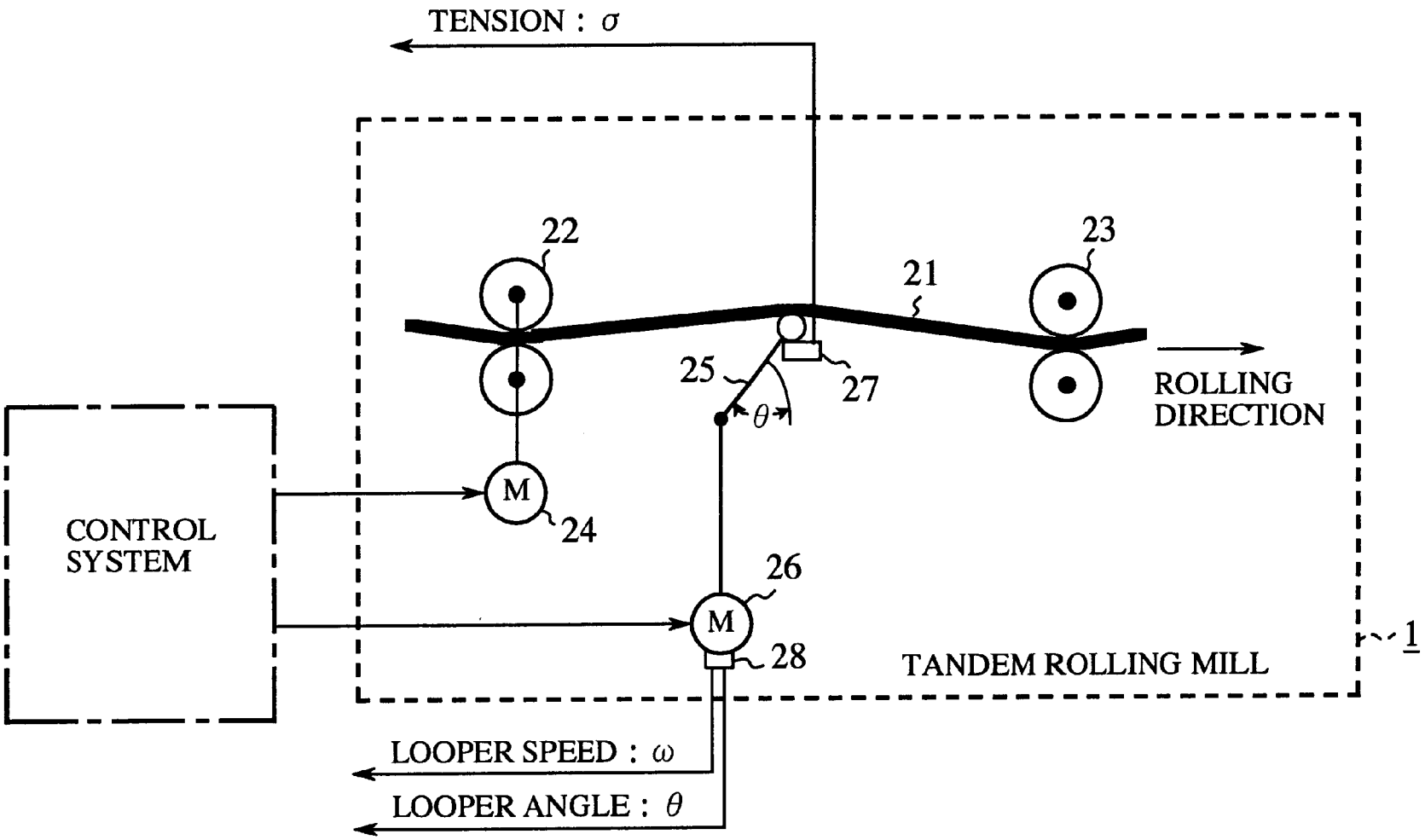
FIG. 1 is a general constitutional diagram showing a major part of a tandem rolling mill.
Figure 2:
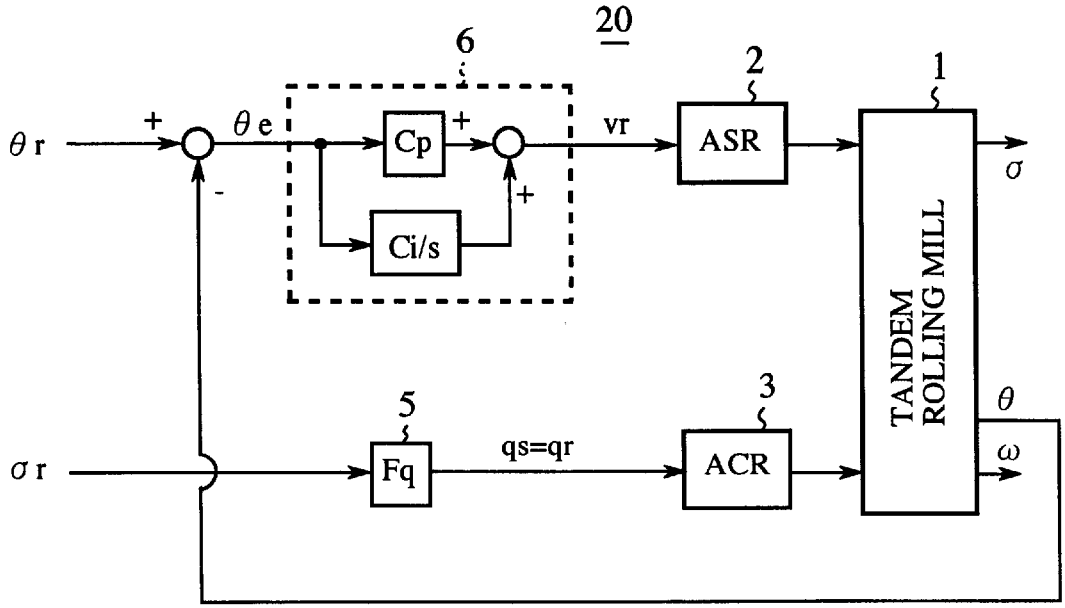
FIG. 2 is a block diagram of a control system for a tandem rolling mill according to a first prior art.

First, the operation of the tandem rolling mill will be described referring to FIG. 1. In an ordinary tandem rolling equipment, a plurality (usually, 6 or 7) of mill stands are disposed successively, but the following description will be focused on the operation between a pair of mill stands of the tandem rolling mill 1. At each mill stand (former-stage mill stand 22), the rolls are driven to rotate by a mill motor 24 while performing a draft by the rolls, and rolling is conducted by feeding out a strip 21. Between the mill stands, a looper 25 driven by a looper motor 26 and accessory mechanisms are disposed. The mill speed controller 2 performs such a control that the speed of the mill motor 24 coincides with a mill speed command vr, while the looper torque controller 3 performs such a control that the torque of the looper motor 26 coincides with a torque command qr. The control system 50 appropriately calculates the mill speed command vr and the looper torque command qr, and performs such a control that the strip 21 maintains a fixed tension, and the strip 21 maintains a fixed loop (curve) between the stands, namely, the angle at the looper 25 is fixed.

First, the operation of the low-speed arithmetic unit 4 shown in FIG. 5 will be described. The low-speed arithmetic unit 4 is externally supplied with a tension command $\sigma r$ and a looper angle command $\theta r$, and is supplied with the tension $\sigma$ of the strip 21 detected by the tension detector 27 shown in FIG. 1 and the looper angle $\theta$ detected by the looper angle detector 28. While the tension detector 27 is constituted, for example, of a load cell attached to the tip end of the looper 25, the tension $\sigma$ can also be detected based on a driving current in the looper motor 26, and, in that case, a driving current detector constitutes the tension detector 27. Inside the low-speed arithmetic unit 4, a tension setting torque arithmetic unit 5 acts based on the tension command $\sigma r$, and, in the condition where the tension $\sigma$ of the strip 21 steadily conforms to the tension command $\sigma r$, calculates the torque of the looper motor 26 for supporting the strip 21 by the looper 25 in a feed-forward manner, and outputs the calculated value as a tension setting torque qs. On the other hand, the looper angle controller 6 is supplied with an angle deviation $\theta e$ which is a deviation between a looper angle command $\theta r$ and the looper angle $\theta$, and outputs a sum signal of a signal obtained by multiplying the angle deviation $\theta e$ by an angle proportional gain Cp and a signal obtained by integrating the angle deviation $\theta$ e and then multiplying the integrated value by an angle integral gain Ci, namely, performs a PI (proportional integral) arithmetic operation. The tension proportional controller 11 outputs a signal obtained by multiplying by a tension proportional gain $Cv\sigma$ a tension deviation $\sigma e$ which is a deviation between the tension command $\sigma r$ and the tension $\sigma$. The tension intersection proportional controller 12 outputs a signal obtained by multiplying the tension deviation $\sigma e$ by a tension intersection proportional gain $C\omega\sigma$. Incidentally, the angle proportional gain Cp, the angle integral gain Ci, the tension proportional gain $Cv\sigma$, and the tension intersection proportional gain $C\omega\sigma$ are set respectively at predetermined constants.

Here, the low-speed arithmetic unit 4 causes a sum signal of the output of the looper angle controller 6 and a signal obtained by multiplying the output of the tension proportional controller 11 by −1 to be a mill speed command vr, causes the output of the tension intersection proportional controller 12 to be a looper speed command $\omega r$, and causes the tension setting torque qs as a feed-forward torque qf. Further, the low-speed arithmetic unit 4 outputs the feed-forward torque qf and the looper speed command or and inputs them to the looper speed controller 9, and outputs the mill speed command vr and inputs it to the mill speed controller 2.

Incidentally, the method of calculating the mill speed command vr outputted from the low-speed arithmetic unit 4 is not limited to the above-mentioned arithmetic operation method; namely, a feed-forward speed vf calculated in a feed-forward manner according to the speed of the mill motor and the draft of rolls at the latter-stage mill stand 23 may be added.

Here, the arithmetic operations in the low-speed arithmetic unit 4 whose action has been described above is specifically realized by computer, and arithmetic operations may be conducted at the same sampling period, and are conducted at a sampling period of several tens of msec, in the same manner as in the control systems 20, 30, 40 and the like in the tandem rolling mills according to the prior art. Usually, the low-speed arithmetic unit 4 is realized with a computer different from those of the mill speed controller 2 and the looper torque controller 3.

Next, the action of the looper speed controller 9 will be described. The looper speed controller 9 is supplied with a feed-forward torque qf and a looper speed command or outputted from the low-speed arithmetic unit 4, and, based on the looper speed $\omega$ detected by the looper angle detector 28, outputs a sum signal, as a looper torque command qr, of a signal obtained by multiplying the looper speed deviation $\omega e$ which is a deviation between the looper speed command $\omega r$ and the looper speed $\omega$ by a looper speed proportional gain $C q\omega$ at the looper speed proportional controller 10 and the feed-forward torque qf, and inputs the looper torque command qr to the looper torque controller 3. The looper speed proportional gain $C q\omega$ is set at a predetermined constant.

The above-mentioned looper speed controller 9 is realized with a computer, in the same manner as other controllers; here, the looper speed controller 9 is constituted of a computer which performs arithmetic operations by a sampling process at a higher speed than the low-speed arithmetic unit 4. Generally, an ordinary motor drive device is in many cases constituted of a torque controller and a speed arithmetic unit for performing a PI control based on a high-speed sampling process (with a sampling period of about several msec). Therefore, the speed controller provided in the motor drive device is constituted similarly to the above-mentioned looper speed controller 9, whereby it is easy to perform the arithmetic operations in the looper speed controller 9 by a sampling process at a higher speed than the low-speed arithmetic unit 4.

In a speed controller provided in an ordinary motor drive device, in order that the speed of a motor does not have a steady deviation relative to a speed command even when a steady load torque is externally applied to the motor, a feedback control using integration such as a speed PI control is conducted, and the steady load torque is automatically compensated for. Therefore, the steady motor torque cannot be directly set from the exterior of the speed controller. In view of this, in Embodiment 1, as shown in FIG. 5, the looper speed controller 9 does not perform an integral control action, and the tension setting torque qs is fed forward to the looper torque command qr, together with proportional control of the looper speed. Thus, such a control is conducted that the looper speed $\omega$ is 0 and the tension deviation $\sigma e$ is 0 in a steady state, and the tension setting torque qs can be directly set by the low-speed arithmetic unit 4, namely, from the exterior of the looper speed controller 9 so that the torque of the looper motor 26 conforms to the tension setting torque qs. In addition, where no error is generated between the steady tension $\sigma$ balanced with the tension setting torque qs calculated in a feed-forward manner by the tension setting torque arithmetic unit 5 and the steady value of the tension $\sigma$ detected by the tension detector 27, the tension deviation $\sigma e$ is made to be steadily 0 by steadily making the torque of the looper motor 26 conform to the tension setting torque qs. Therefore, the steady value of the tension $\sigma$ can be easily set by the tension setting torque qs in the same manner as in the first prior art. At the same time, variations in the looper speed $\omega$ are compensated for by a high-speed sampling process conducted by the looper speed controller 9, so that the dead time in the control system due to the length of the sampling period can be suppressed to be small, and, hence, the variations in the looper speed ω can be controlled with a sufficient instant response characteristic.

Next, a method of setting a constant for control gain and its effect obtained in Embodiment 1 will be described in detail. First, characteristics of the tandem rolling mill 1 will be described. Here, the mill speed controller 2 and the looper torque controller 3 perform such controls that the speed of the mill motor 24 and the torque of the looper motor 26 conform respectively to the mill speed command vr and the looper torque command qr as swiftly as possible. If sufficiently fast controls are performed, these controls are not related to control characteristics of the tension σ and the looper angle θ; here, therefore, ideally sufficiently fast controls are assumed in the following description.

Figure 6:
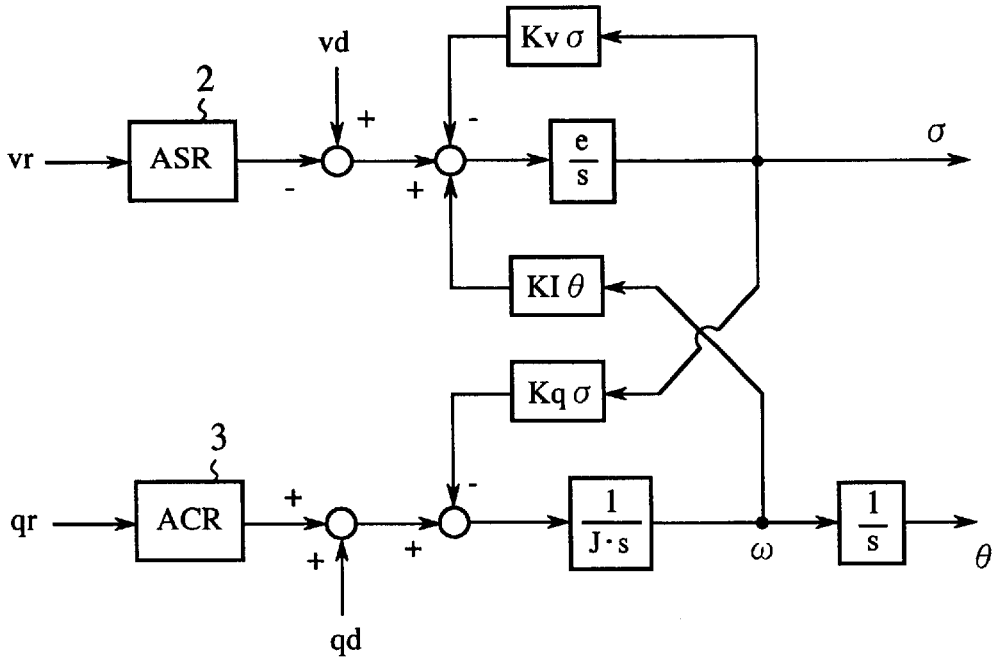
FIG. 6 is a transfer block diagram showing the transfer characteristics of the tandem rolling mill shown in FIG. 1.
Figure 3:
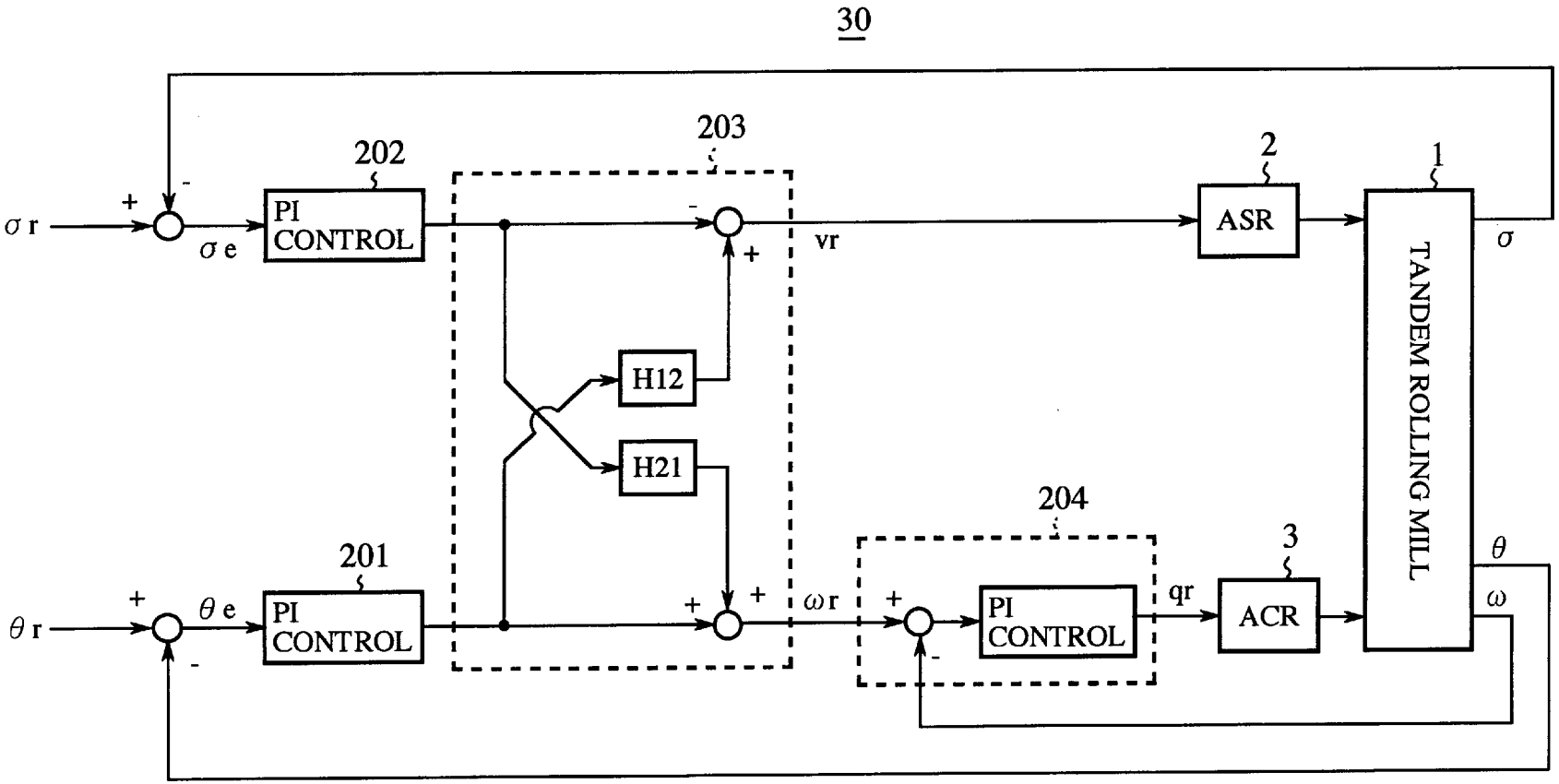
FIG. 3 is a block diagram of a control system for a tandem rolling mill according to a second prior art.
Figure 4:
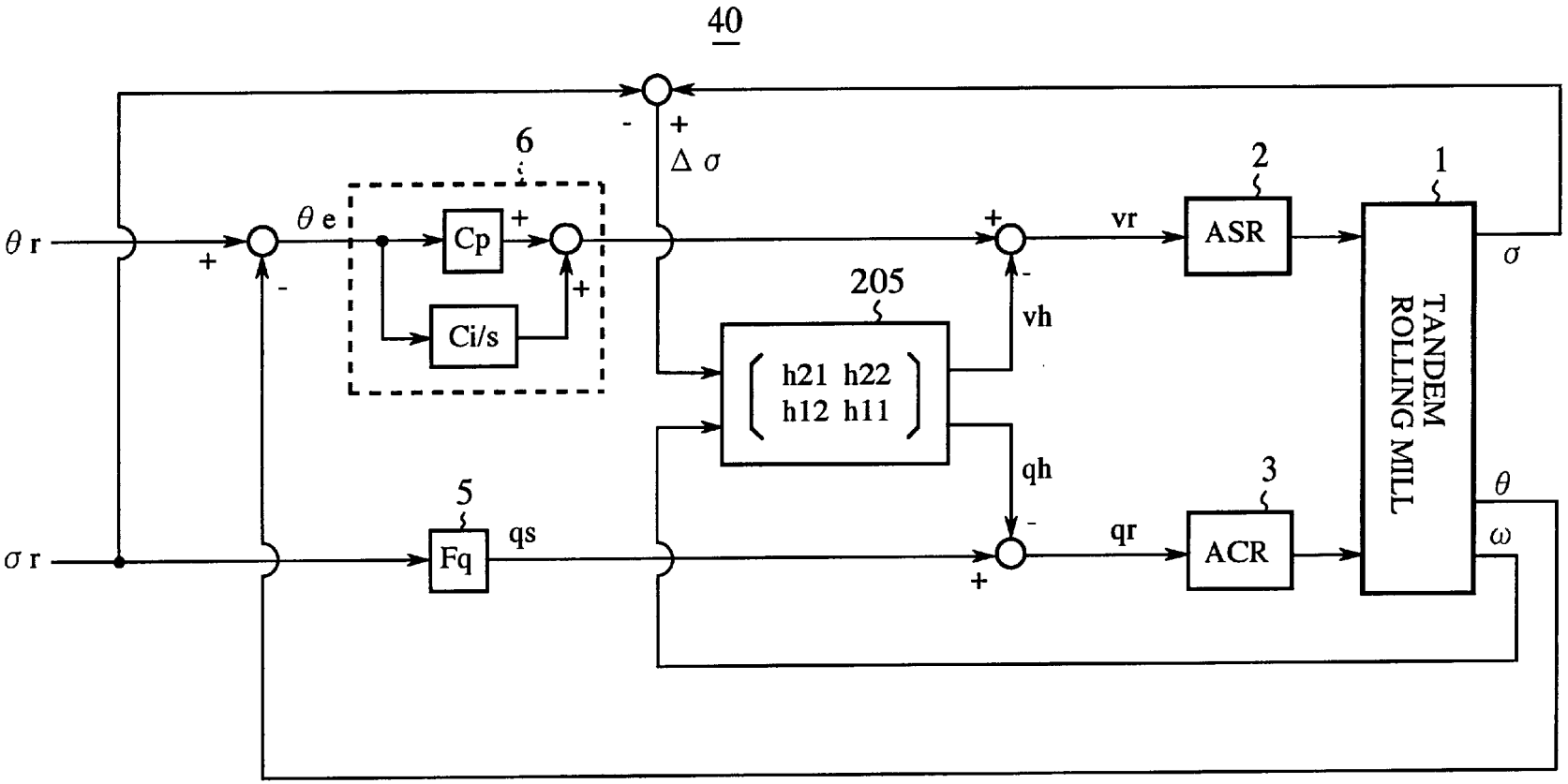
FIG. 4 is a block diagram of a control system for a tandem rolling mill according to a third prior art.

First, from the principle of generation of the tension σ in the strip 21, the tension σ obtained by multiplying the length of elastic elongation of the strip 21 by an elasticity coefficient e determined by Young's modulus and the like is generated. Therefore, when the speed of the strip 21 fed out from the former-stage mill stand 22 is represented as outlet side strip speed vs, the elastic elongation of the strip 21 increases in proportion to the integration of a decrease in the outlet side strip speed vs. In addition, as the looper angle θ increases, the length of the loop of the strip 21 increases in proportion to a coefficient Kl θ, and the length of elastic elongation also increases. Further, the outlet side strip speed vs varies according to mill speed (circumferential speed of roll), and, since rolling is being conducted, the outlet side strip speed vs is faster than the mill speed (circumferential speed of roll) by a coefficient called a forward slip, and the forward slip increases in proportion to a coefficient Kv σ as the tension σ of the strip 21 increases. Besides, the forward slip factor varies due also to variations in temperature and variations in the rolling draft, so that the variation is represented as a strip speed disturbance vd. The increase in the tension σ acts on the looper 25 as a torque (coefficient is Kq σ) in the direction that reduces the looper angle θ. Besides, the torque of the looper motor 26 generated according to the looper torque command qr is exerted on the looper 25, and, further, variation in the weight of the strip 21 and friction of a shaft of the looper 25 act as a looper torque disturbance qd. When the inertia of the looper 25 is represented as J, the torque exerted on the looper 25 generates an acceleration of the looper 25 in proportion to 1/J; the acceleration is integrated to be a looper speed ω, and the looper speed ω is integrated to be a looper angle θ. In summing up the above characteristics, the transfer characteristics of the tandem rolling mill 1 are represented by the transfer block diagram of FIG. 6, and from the figure, there are obtained the state equations of Eqs. (1) to (3):

$$d\sigma/dt=-all\cdot\sigma+a12\cdot\omega+b1\cdot vd-b1\cdot vr \quad (1)$$

$$d\omega/dt=-a21\cdot\sigma+b2\cdot qd+b2\cdot qr \quad (2)$$

$$d\theta/dt=\omega \quad (3)$$

where the coefficients in the above equations are given by the following Eqs. (4) to (8).

$$a11=e\cdot Kv\sigma u \quad (4)$$

$$a12=e\cdot Kl\theta \quad (5)$$

$$a21=Kq\sigma/J \quad (6)$$

$$b1=e \quad (7)$$

$$b2=1/J \quad (8)$$

Here, the strip speed disturbance vd necessarily varies with the variations in the temperature and the rolling draft of the strip 21, and constitutes the disturbance which causes variations in the tension σ and the looper angle θ. On the other hand, the looper torque disturbance qd does not vary largely unless the looper angle θ varies; therefore, the major cause of variations in the tension σ and the looper angle θ is the strip speed disturbance vd.

Here, the characteristic equation (denominator polynomial of transfer function) of the tandem rolling mill 1 represented by Eqs. (1) to (3) above is represented by the following Eq. (9):

$$p(s)=s^3+a11\cdot s^2+a12\cdot a21\cdot s \quad (9)$$

where s is a Laplace operation, and the characteristic equation in the above and the following description is dealt with by normalizing so that the coefficient of the highest order of s becomes 1.

By the way, the characteristic polynomial such as Eq. (9) represents convergent characteristic of state variables of a control system in response to various disturbances, the root with respect to s in the characteristic polynomial (s where characteristic polynomial=0 is given) is called pole, and the positional relationship of the poles on a complex plane represents the characteristics of the control system, as is generally well known. It is also known that where the ratios of coefficients in the characteristic polynomial are in a specific relationship such as, for example, a binomial coefficient standard form or a Butterworth standard form described in "PID Seigyo (PID Control)" (Asakura Shoten Publishing Co., Ltd.) pp. 13–15 or a standard form of coefficient diagram method described in The Institute of Electrical Engineers Papers Vol. 120-D, No. 4, p. 609, the control system is not oscillating but is stable and has good control characteristics. In the characteristic polynomial of the tandem rolling mill of Eq. (9) above, the coefficient of the term of the 0-th order of s (constant term) is 0. This shows that the tandem rolling mill 1 has a characteristic called an astatic system, and a variable steadily diverges to infinity under some disturbance. Specifically, where no control is applied to, there arises a phenomenon that the looper angle θ diverges under some disturbance. In addition, in the characteristic polynomial of the tandem rolling mill 1 of Eq. (9), ordinarily, the coefficient of the second order of s is smaller than that in a good ratio relationship relative to the coefficient of the first order of s; as a result, the pole is a complex number with a large imaginary part, and the tandem rolling mill 1 shows an oscillating behavior.

Next, characteristics of a control system where the control system 50 of FIG. 5 performing the above-mentioned actions is used for the tandem rolling mill 1 described above will be described. The characteristic polynomial of a closed loop is represented by the following Eq. (10):

$$p(s)=s^4+k3\cdot s^3+k2\cdot s^2+k1\cdot s+k0 \quad (10)$$

where the coefficient kn (n=0, 1, 2, 3) in the Eq. (10) above are represented by the following Eqs. (11) to (14):

$$k3=a11+b1\cdot Cv\sigma+b2\cdot Cq\omega \quad (11)$$

$$k2=(a11+b1\cdot Cv\sigma)b2\cdot Cq\omega+(a21+b2\cdot Cq\omega\cdot C\omega\sigma)a12 \quad (12)$$

$$k1=a21\cdot b1\cdot Cp \quad (13)$$

$$k0=a21\cdot b1\cdot Ci \quad (14)$$

where the symbols starting with a and b in the above Eqs. (11) to (14) are values determined by the physical characteristics of the tandem rolling mill 1, as indicated in Eqs. (4) to (8), and the symbols starting with C are setting gains of the control system.

From Eqs. (10) to (14) above, the coefficient k3 of the cube of s in the characteristic polynomial of Eq. (10) can be independently set by the tension proportional control gain Cvσ and the looper speed proportional gain Cq a, the coefficient k2 of the square of s can be independently set by the tension intersection proportional gain Cωσ, and the coefficients k1 and k0 of s to the first power and s to the 0-th power (constant term) can be independently set by the angle proportional gain Cp and angle integral gain Ci of the looper angle controller 6. Namely, the coefficients of the characteristic polynomial of Eq. (10) can all be independently set, and the positions of the poles can be arbitrarily set. Therefore, by setting the ratios of coefficients and poles in the characteristic polynomial in good relationships, an optimum control can be realized with the control system 50 having a comparatively simple structure shown in FIG. 5.

Figure 7:
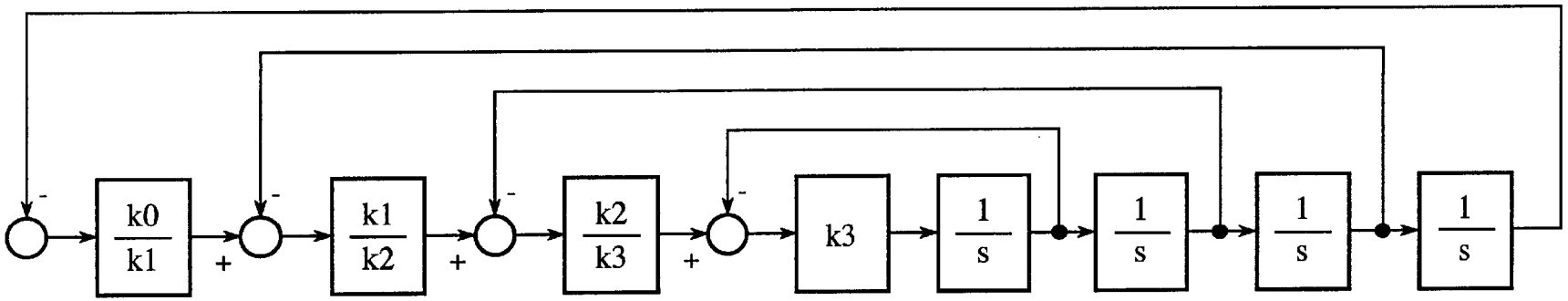
FIG. 7 is a transfer block diagram showing a closed loop structure of the control system shown in FIG. 5 as a cascade structure of integral characteristics.

Next, when the characteristic polynomial is represented by the above Eq. (10), the closed loop structure of the control system can be represented by a cascade structure of integral characteristic as shown in FIG. 7 by performing linear state transformation. In FIG. 7, inputs and outputs are omitted. It is widely known that, in order to achieve stable control characteristics in a control system with a cascade structure as shown in FIG. 7, for example, as the relationship between speed control and position control in motor control, the response characteristic of a control loop on the inner side (speed control in motor control) must be set at a higher speed than the response characteristic of a control loop on the outer side (position control in motor control). Here, the case where the ratios of coefficients in a characteristic polynomial are in good relationships as described above means that, when it is applied to the cascade structure shown in FIG. 7, the response characteristic of the control loop on the inner side is set at a several times higher speed than the response characteristic of the control loop on the outer side.

In addition, in order to enhance the speed of response characteristic of the control system as a whole, it suffices to enhance the response characteristic of the entire control loops while maintaining the ratios of coefficients in the characteristic polynomial in good relationships, namely, while maintaining the response characteristic of the control loop on the inner side at a several times higher speed than the response characteristic of the control loop on the outer side. Therefore, by such a constitution that the innermost control loop has a fastest response, a control system with response characteristic at the highest speed possible can be realized. From the relationship of Eq. (11), the innermost control loop in the control system of Embodiment 1 shown in FIG. 5 corresponds to the control loop of the tension proportional controller 11 with the gain of Cvσ and the looper speed proportional controller 10 with the gain of Cqω, and it is seen that, in order to realize a stable high-speed response of the control system as a whole, it suffices to provide the innermost control loop with a highest-speed response characteristic.

Therefore, the control loop of the looper speed proportional controller 10 which is one of the innermost control loops, namely, the control loops requiring the fastest response characteristic is performed by arithmetic operation with a fastest sampling period in the looper speed controller 9, whereby the dead time due to sampling is reduced and high-speed response can be realized. Thus, the response of the entire control system shown in FIG. 5 can be enhanced in speed.

Next, the properties of control loops in the control system 50 for the tandem rolling mill shown in FIG. 5 will be described from a physical point of view. When the gains of the looper speed proportional controller 10, the tension proportional controller 11 and the tension intersection proportional controller 12 in the control system shown in FIG. 5 are set to be 0, the control system is the same as that in the first prior art. Namely, feedback control is performed only at the looper angle controller 6, and, as a result, the control can be easily performed although there is a limitation that the speed of response is reduced, as has been described above. Thus, as viewed from the first prior art which is the simplest, adding the tension proportional controller 11 and enlarging the gain Cvσ means proportionally compensating for the tension variation with the mill speed command vr; as a result of the proportional compensation, the tension variation is suppressed, and concurrently a vibration-damping effect of the control system is enhanced, as is easily understood.

On the other hand, adding the looper speed proportional controller 10 and enlarging the gain Cqω means proportionally compensating the variation in the looper speed ω with a looper torque command qr, and variations in the looper speed ω in response to variations in the torque externally exerted on the looper 25 and the looper motor 26 is suppressed. In Embodiment 1, the feedback of the looper speed o in the looper speed controller 9 performs a proportional control and does not perform an integral control, so that the looper speed X would not become 0 with the result of stoppage unless the tension deviation σe is 0, the variations in the looper angle θ is not excessively suppressed as compared to the case where the looper speed controller 9 performs also an integral control, and there is little risk that the looper 25 might be separated from the strip 21.

Adding the tension intersection proportional controller 12 and enlarging the gain Cωσ a means compensating for the tension σ by actively operating the looper 25 in response to variations in the tension σ. The effect of the tension intersection proportional controller 12 is the same, with respect to the direction of variation of the looper angle θ in response to the tension σ, as in the first prior art not using the looper speed controller 9; however, the variations in the tension σ can be further reduced as much as the looper 25 is operated faster by the looper speed controller 9. Namely, there is obtained the same effect as that of reducing the inertia of the looper 25. The sign of the gain Cωσ of the tension intersection proportional controller 12 is naturally positive, and the sign of the gain Cqω of the looper speed proportional controller 10 is also positive, so that the action is in the direction that reduces the looper torque command qr in response to an increase in the tension σ. The looper angle controller 6 compensates the variation width in the looper angle θ by varying the mill speed command vr at a frequency lower than that of the control of the tension σ as above-mentioned, so that the variation of the looper angle θ would not be excessively large. In addition, the response of the looper speed ω in response to variation in the tension σ is made to be faster by the action of the tension intersection proportional controller 12, so that the response characteristic of the looper angle controller 6 can be set high, and, as a result, the response characteristic of the control system as a whole can be enhanced, and the variation in the looper angle θ can be suppressed.

As described above, the present embodiment has a simple structure obtained by only adding three proportional control loops, namely, the tension proportional controller 11, the tension intersection proportional controller 12 and the looper speed proportional controller 10 in the looper speed controller 9, to the first prior art which is the simplest control system, and, yet, the three proportional control loops can be adjusted independently from each other. Therefore, the response characteristic of the control system as a whole can be gradually enhanced to a perfection region by a simple adjustment of adding the proportional control loops one by one. Besides, the torque command qr outputted from the looper angle controller 9 does not contain a component obtained by integrating the looper angle deviation θe, so that the steady value of the looper angle θ is not controlled separately from the steady value of the tension σ, and control with high accuracy can be realized with a simple adjustment based on a one-loop control by the looper angle controller 6.

Thus, provoked by the one-loop control of the first prior art, the control system with high accuracy can be realized by adding simple adjustments while setting the proportional control gains one by one, owing to the following three points. Firstly, such a constitution is adopted that an integral component of the looper angle deviation θe is not added to the looper torque command qr, and an integral component of the tension deviation σe is not added to the mill speed command vr, whereby the steady value of the tension σ and the steady value of the looper angle θ are not controlled separately, and the steady value of the tension deviation σe necessarily affect the steady value of the looper angle θ. Secondly, such a constitution is adopted that the steady value of the tension σ is set in a feed-forward manner by the tension setting torque qs, and the steady value of the looper angle θ is controlled by the action of the looper angle controller 6. Thirdly, such a constitution is adopted that the looper speed controller 9 performs a proportional control but does not perform an integral control, and the variations in the looper angle θ in response to the variations in the tension σ are not excessively suppressed.

Figure 8:
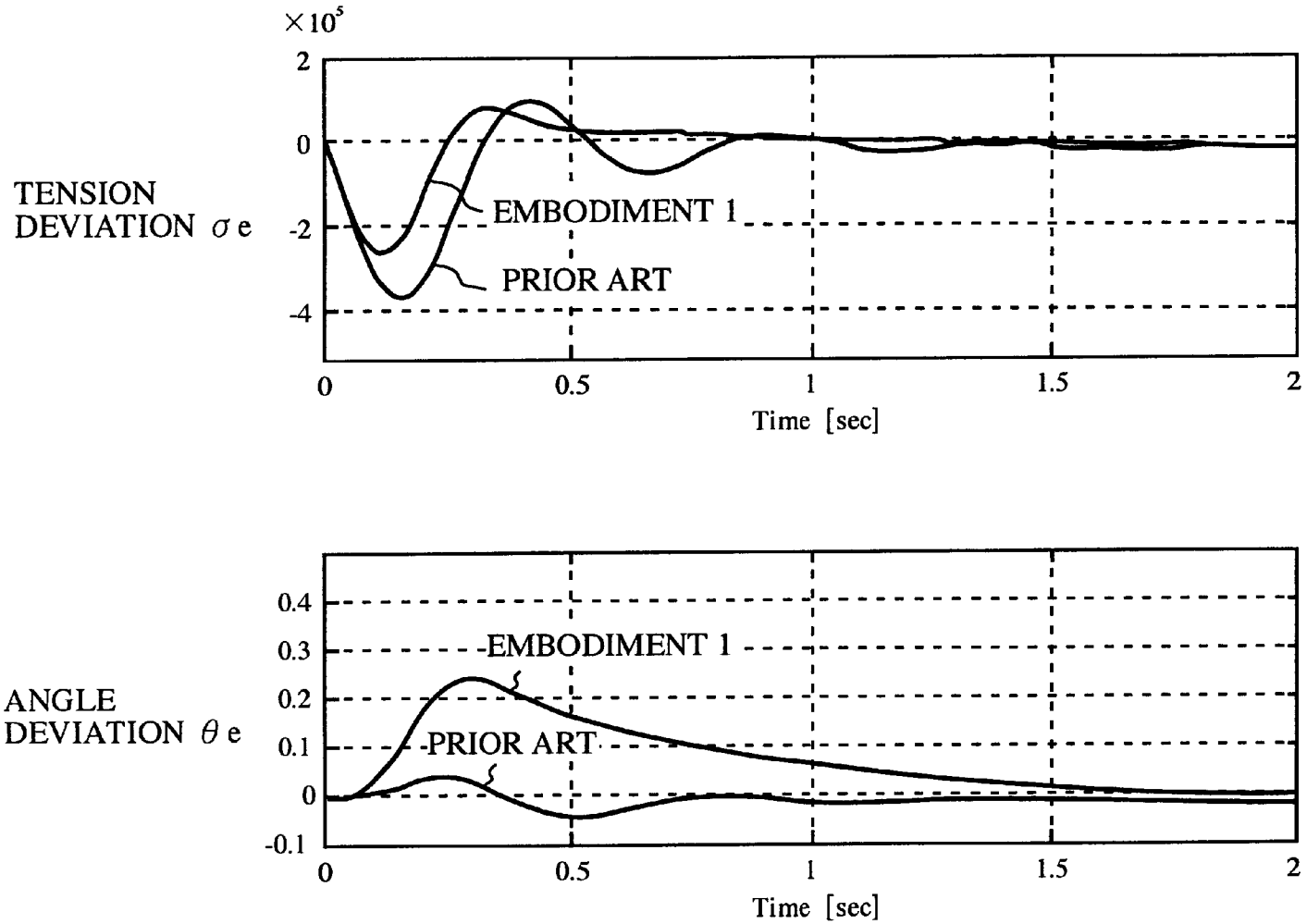
FIG. 8 is a diagram showing, along the lapse of time, the transient response when a stepwise external disturbance is applied to the control system for the tandem rolling mill shown in FIG. 5.

FIG. 8 shows the results of a simulation of the case where the control system 50 for the tandem rolling mill according to the present embodiment is used and a stepwise strip speed disturbance vd is applied. In the simulation shown in the figure, modeling errors are taken into consideration, and, particularly, a delay in transfer characteristics from the mill speed command vr to the outlet side strip speed vs is taken into consideration. FIG. 8 also shows the response in the case where the second prior art is used, for comparison. As is clear from the figure, in the second prior art, the variation in the looper angle θ is suppressed and it is tried to control the tension σ only by the mill motor 26, and, as a result, stability is deteriorated with the result of vibration due to the influence of the above-mentioned modeling errors. On the other hand, in Embodiment 1, the control of the tension σ can be performed by moving the looper angle θ faster and actively, whereby stability is enhanced, and variations in the tension σ are reduced, as is seen.

In Embodiment 1, the tension setting torque qs is directly used as a feed-forward torque qf, and the output of the tension intersection proportional controller 12 is inputted to the looper speed controller 9 as a looper speed command ωr. Also possible is a constitution in which the looper speed command ωr is steadily 0, and the sum of the tension setting torque qs and a signal obtained by multiplying the output of the tension intersection proportional controller 12 by a looper speed proportional gain Cqω is used as a feed-forward torque qf; in that case, also, an action equivalent to the above is achieved.

Embodiment 1 is constituted as above, in which a signal obtained by performing a PI arithmetic operation on the looper angle deviation is added to the mill speed command vr, an integral component of the looper angle deviation θe is not added to the looper torque command qr, and a plurality of proportional control loops are added. Thus, a control with high accuracy can be realized by simple adjustments based on the first prior art which is a simplest system, namely, a one-loop control by the looper angle controller 6.

Further, in the control loop which requires the fastest response, the arithmetic operation for adding a proportional component of the looper speed ω to the looper torque command qr is performed by the looper speed controller 9 with a high-speed sampling process, whereby the response of the control loop requiring the fastest response can be enhanced in speed, and, as a result, the response of the control system as a whole can be enhanced in speed.

Further, the looper speed controller 9 is so constituted that a signal obtained by adding the tension setting torque qs to a signal obtained by proportionally multiplying the deviation between the looper speed command ωr and the looper speed ω is used as a looper torque command qr, whereby the steady value of the looper torque command qr can be directly set from the exterior of the looper speed controller 9, so that a simple controller constitution and easy adjustment are possible in the same manner as in the first prior art. In addition, since the looper speed controller 9 does not perform an integral control, the variations in the looper angle θ are not excessively suppressed, and easy adjustment can be made.

Further, the gain Cωσ of the tension intersection proportional controller 12 is positive, and the looper torque command qr is decreased (increased) as the tension σ increases (decreases), whereby the response of the looper speed ω to the increase (decrease) in the tension σ is faster than in the case where the gain Cqω of the looper speed proportional controller 10 in the looper speed controller 9 is 0, and is larger than in the case where the gain Cωσ of the tension intersection proportional controller 12 is 0. Namely, the variation in the tension σ is compensated for by moving the looper 25 actively and fast, whereby the variation of the tension σ can be suppressed to be more smaller.

Embodiment 2

Figure 9:
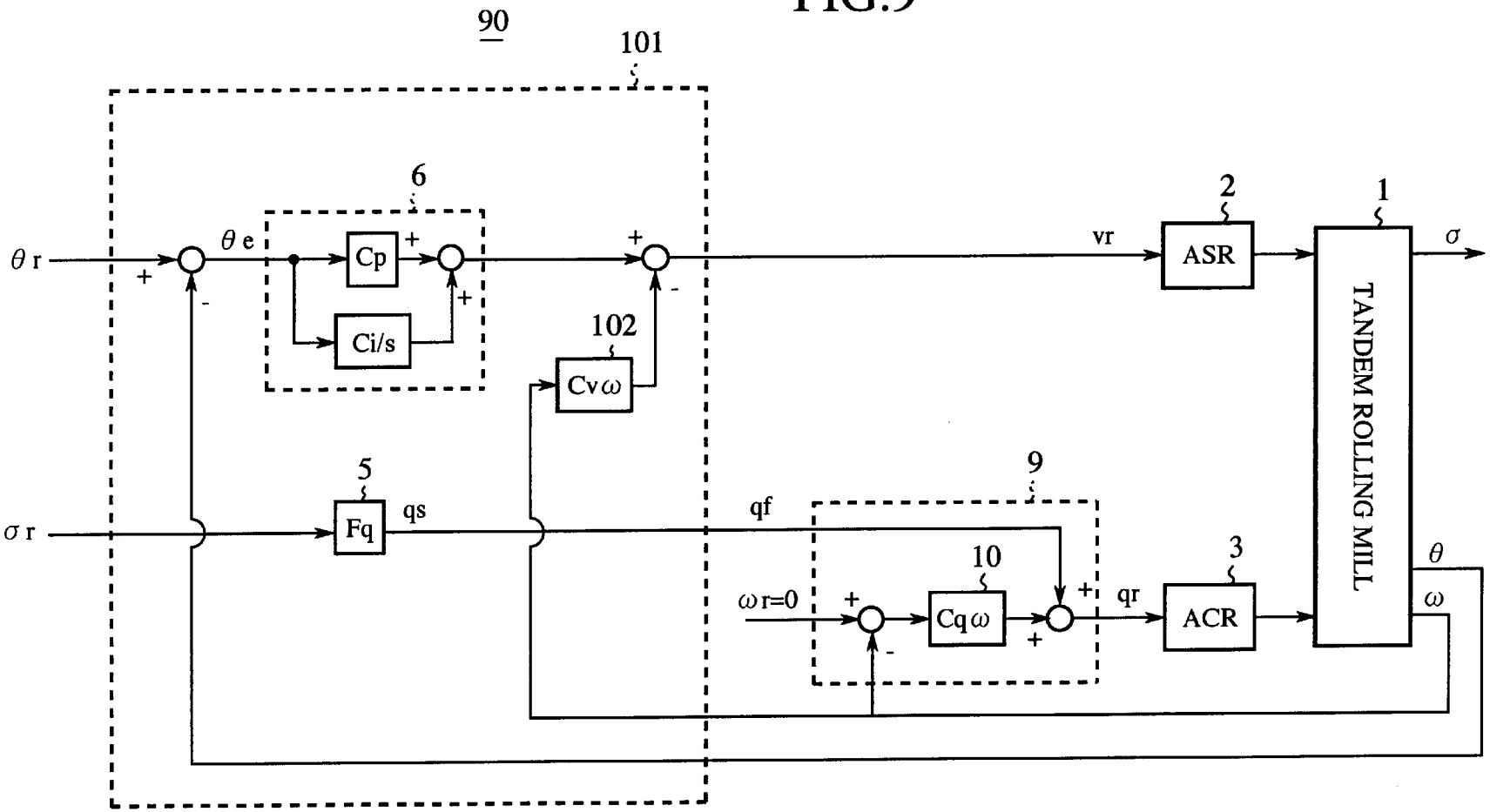
FIG. 9 is a block diagram of a control system for a tandem rolling mill according to Embodiment 2 of the present invention.

FIG. 9 is a block diagram of a control system for a tandem rolling mill according to Embodiment 2 of the present invention. In the figure, the same symbols as those in FIG. 5 denote the same portions, and description thereof is omitted. Numeral 90 denotes a control system, 101 denotes a low-speed arithmetic unit, and 102 denotes a looper speed intersection proportional controller. The constitution of the tandem rolling mill is the same as shown in FIG. 1. As will be described in detail below, in Embodiment 2, in the same manner as in the first prior art, such a constitution is adopted that the tension detector 27 used in Embodiment 1 is not provided, but a reasonable control effect can be obtained.

Now, action or operation of Embodiment 2 will be described.

A low-speed arithmetic unit 101 is externally supplied with a tension command σr and a looper angle command ωr, and is also supplied with a looper angle θ and a looper speed ω which are detected by a looper angle detector 28. In addition, a tension setting torque qs is calculated, in the same manner as in Embodiment 1, and is outputted as a feed-forward torque qf. Besides, a looper angle controller 6 outputs a signal obtained by a PI arithmetic operation, in the same manner as in Embodiment 1. A looper speed intersection proportional controller 102 outputs a signal obtained by multiplying the looper speed ω by a set looper speed intersection proportional gain Cvω. In addition, the low-speed arithmetic unit 101 outputs as a mill speed command vr a sum signal of the output of the looper angle controller 6 and a signal obtained by multiplying the output of the looper speed intersection proportional controller 102 by −1, and inputs the mill speed command vr to a mill speed controller 2. Besides, the looper speed controller 9 is supplied with the above-mentioned feed-forward torque qf, and is always supplied with 0 as the looper speed command ωr. The action of the looper speed controller 9 is the same as in Embodiment 1, and performs arithmetic operations with a sampling period at a higher speed than the low-speed arithmetic unit 101.

Since the above actions are performed in Embodiment 2, the characteristic polynomial of a closed loop including the transfer characteristics of the tandem rolling mill 1 represented by Eqs. (1) to (3) in the description of Embodiment 1 is represented by the following Eq. (15) having the same form as Eq. (10), and the coefficients therein are represented by the following Eqs. (16) to (19):

$$p(s)=s^4+k3\cdot s^3+k2\cdot s^2+k1\cdot s+k0 \quad (15)$$

$$k3=a11+b2\cdot Cq\omega\omega \quad (16)$$

$$k2=(a12+b1\cdot Cv\omega)a21 \quad (17)$$

$$k1=a21\cdot b1\cdot Cp \quad (18)$$

$$k0=a21\cdot b1\cdot Ci \quad (19)$$

In the above Eqs. (16) to (19), the symbols starting with a and b are values determined by physical characteristics of the tandem rolling mill 1, as indicated by Eqs. (4) to (8) in the description of Embodiment 1, and the symbols starting with C are set gains of the control system.

From the above Eqs. (15) to (19), it is seen that the coefficient k3 of the cube of s in the characteristic polynomial of Eq. (15) can be independently set by the looper speed proportional gain Cqω, the coefficient k2 of the square of s can be independently set by the looper speed intersection proportional gain Cvω, and the coefficients k1 and k0 of s to the first power and s to the 0-th power (constant term) can respectively be independently set by the angle proportional gain Cp and the angle integral gain Ci of the looper angle controller 6. Namely, the coefficients in the characteristic polynomial of Eq. (15) can all be independently set, and layout of poles can be arbitrarily set. Further, it is also understood that, since the ratios of coefficients in the characteristic polynomial and the layout of poles can be set to be in good relationship, an optimum control can be realized with the simple control system 90 shown in FIG. 9.

In addition, in the same manner as in Embodiment 1, arithmetic operations in the looper speed proportional controller 10 in the looper speed controller 9 are performed with a sampling period at a higher speed than that in the low-speed arithmetic unit 101, so that the response of the looper speed proportional controller 10 with a gain of Cqω can be set at a high speed. Besides, since this control loop corresponds to the innermost control loop as described in Embodiment 1, the response of the control system as a whole can be enhanced in speed, and the accuracy of control of tension can be enhanced.

In addition, in the same manner as in the description of Embodiment 1, the accuracy of control of tension can be enhanced by simple adjustment of adding proportional control loops one by one to a one-loop control by the looper angle controller 6 according to the first prior art which is the simplest control system for operation.

Here, comparing this Embodiment 2 with Embodiment 1, the above-mentioned innermost control loop for varying the coefficient of the cube of s in the characteristic polynomial of Eq. (15) is only the control loop for feeding back the looper speed ω to the looper torque command qr, and there is no control loop for feeding back the tension σ to the mill speed command vr as in Embodiment 1, so that Embodiment 2 cannot display faster response than Embodiment 1. In addition, as a control loop for varying the coefficient k2 of the square of s in the characteristic polynomial of Eq. (15), Embodiment 1 adopts such a constitution that the variations in tension σ is compensated for by actively operating the looper 25 under the effect of the tension intersection proportional controller 12, whereas Embodiment 2 adopts such a constitution that the variations in the looper speed ω is damped with the use of a mill speed command vr under the effect of the looper speed intersection proportional controller 102. Namely, in this Embodiment 2 the looper 25 is not actively utilized for tension control, and the effect of enhancing the accuracy of control of tension σ is weak, as compared with Embodiment 1.

Thus, although the accuracy of control of tension σ is not enhanced in Embodiment 2 as compared to Embodiment 1, Embodiment 2 is based on a simpler control system not using a tension detector 27, and a tension control with a higher accuracy than that in the first prior art can be realized with an easy adjustment. In addition, since the looper speed controller 9 with a fast sampling period is used, the response of the control system as a whole can be enhanced in speed, and a tension control with high accuracy can be realized. Incidentally, the looper speed intersection proportional controller 102 may be added to the low-speed arithmetic unit 4 in the control system 50 shown in Embodiment 1. In particular, where it is desired to further reduce the variation of looper angle θ, although difficulty in adjustment is increased as much as the increase of an adjustment gain Cvω, the combined use of the looper speed intersection proportional controller 102 weakens the effect of actively using the looper 25 for tension control and further reduces the variation of the looper angle θ, whereby an optimum control can be realized by adjusting the ratio of using the mill motor 24 and the looper motor 26 for tension control.

Embodiment 3

Figure 10:
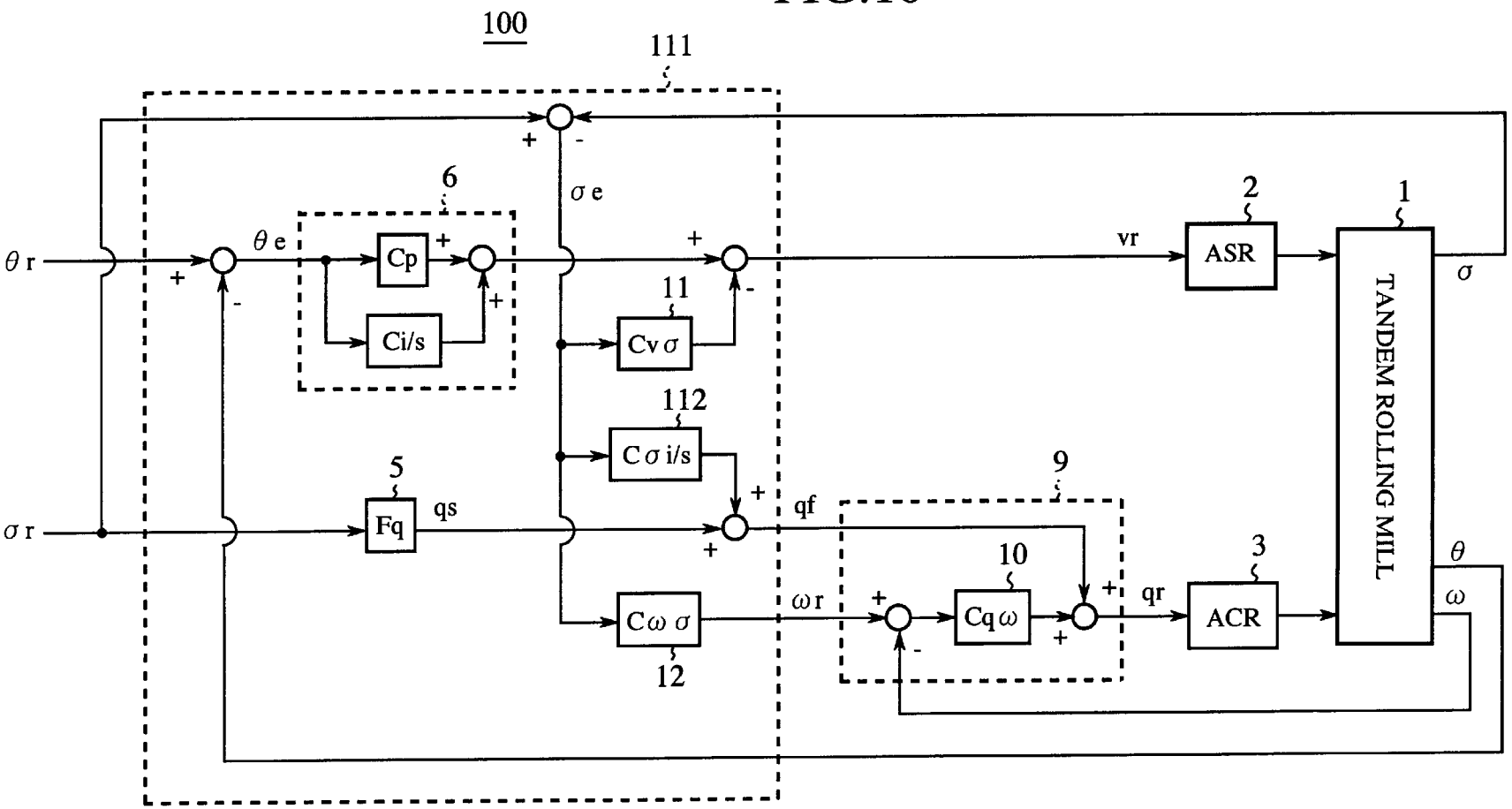
FIG. 10 is a block diagram of a control system for a tandem rolling mill according to Embodiment 3 of the present invention.

FIG. 10 is a block diagram of a control system for a tandem rolling mill according to Embodiment 3 of the present invention. In the figure, the same symbols as those in FIG. 5 denote the same portions, and description thereof is omitted. Numeral 100 denotes a control system, 111 denotes a low-speed arithmetic unit, and 112 denotes a tension integral controller. The constitution of the tandem rolling mill 1 is the same as in Embodiment 1, as shown in FIG. 1. In the description of Embodiment 1, an example has been taken in which there is no offset error between the value of tension σ steadily balanced with the tension setting torque qs calculated by the tension setting torque arithmetic unit 5 and a steady detected value of tension σ detected by the tension detector 27. In the case where, for example, a load cell attached to the tip end of the looper 25 is used as the tension detector 27, there are cases where there is the above-mentioned offset error due to an arithmetic operation error of the tension setting torque arithmetic unit 5 or a detection and arithmetic operation error of the tension detector 27, and, in such a case, there is a steady error between the tension command σr and the tension σ detected by the tension detector 27 in Embodiment 1. Embodiment 3 is for eliminating the steady error between the tension σ detected by the tension detector 27 and the tension command σr in such cases.

Next, action or operation will be described.

The low-speed arithmetic unit 111 is supplied with a tension command σr, angle command θr, tension σ and looper angle θ, in the same manner as the low-speed arithmetic unit 4 in Embodiment 1, outputs a mill speed command vr by the same arithmetic operation as in Embodiment 1, and inputs it to a mill speed controller 2. In addition, the low-speed arithmetic unit 111 calculates a tension setting torque qs and a looper speed command ωr by the same arithmetic operations as those in Embodiment 1.

The tension integral controller 112 outputs a signal obtained by multiplying the tension deviation σe which is a deviation between the tension command σr and the tension σ by a set tension integral gain Cσi and integrating the product. The low-speed arithmetic unit 111 uses a sum signal, as a feed-forward torque qf, of the tension setting torque qs and the output of the tension integral controller 112, outputs the feed-forward torque qf and the looper speed command ωr described above, and inputs them to the looper speed controller 9. The action of the looper speed controller 9 is the same as in Embodiment 1.

With the above actions, in this Embodiment 3, even if there is an offset error between the tension setting torque qs calculated by the tension torque arithmetic unit 3 and the tension σ detected by the tension detector 27, the deviation between the tension command σr and the tension σ is integrated, and the feed-forward torque qf is corrected so as to eliminate a steady deviation. In addition, the correction of the above-mentioned offset error may be carried out by steadily correcting a fixed value and may therefore be performed slowly, as contrasted to the compensation of the strip speed disturbance vd described in Embodiment 1. Therefore, the tension integral gain Cσi may have a small value, and the dynamic characteristics of the control system can be roughly the same as in Embodiment 1. Besides, it goes without saying that good control characteristics can be achieved with a simple adjustment of adding control loops one by one, in the same manner as in Embodiment 1.

Here, when there is assumed the case of, for example, adding a control loop for adding an integral component of the tension deviation σe to the mill speed command vr, instead of adding the tension integral controller 112 as shown in FIG. 10, in order to eliminate the steady error between the tension command σr and the tension σ, an action of steady correction to the mill speed command vr is generated irrespectively of the looper angle θ, so that there arises the problem that the looper angle θ has a steady error relative to the looper angle command θr. In order to prevent such a problem, it is necessary to add the integral component of the tension deviation σe to the mill speed command vr and, at the same time, add a component obtained by integrating the looper angle deviation θe to the looper torque command qr, so that the number of control loops is increased, and there arise the problems such as the instable phenomenon based on the interference between the control of tension σ and control of looper angle θ as described in the second prior art, whereby adjustment of the control system becomes difficult. Therefore, as described in this Embodiment 3, by adding a control loop of not adding the signal obtained by integration of the tension deviation σe to the mill speed command vr but adding the signal only to the looper torque command qr, it is unnecessitated to add a control loop of adding an integral component of the looper angle deviation θe to the looper torque command qr, and the steady deviation of the tension σ can be easily eliminated. Here, the effect of easily eliminating the steady deviation of the tension σ is irrelevant to the enhancement of the speed of sampling period of the looper speed controller 9, and a similar effect is obtained in the case where the same arithmetic operation as that of the looper speed controller 9 is performed with a slow sampling period inside the low-speed arithmetic unit 111.

While in this Embodiment 3 the tension setting torque qs calculated by the tension setting torque arithmetic unit 5 based on the tension command σr is added to the feed-forward torque qf, the steady value of the feed-forward torque qs is compensated for by the tension integral controller 112, so that a similar control action can be realized steadily without particularly calculating the tension setting torque qs and adding it to the feed-forward torque qf.

As described above, in this Embodiment 3, there is no steady deviation between the tension command σr and the tension σ even in the case where the arithmetic operation of the tension setting torque qs in the tension setting torque arithmetic unit 5 has an offset error, and high-accuracy control of the tension σ can be realized with a simple adjustment, in the same manner as in Embodiment 1.

Embodiment 4

Figure 11:
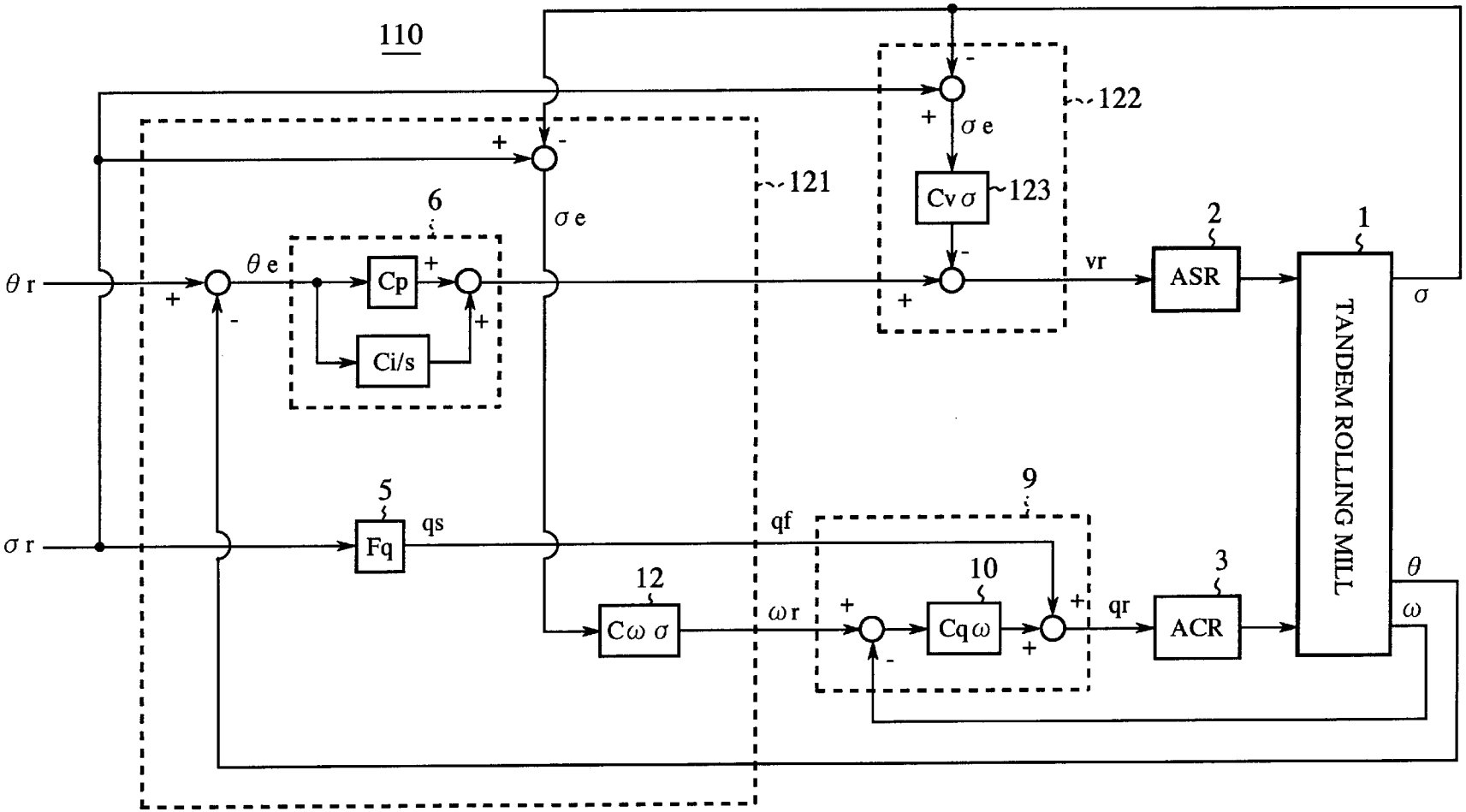
FIG. 11 is a block diagram of a control system for a tandem rolling mill according to Embodiment 4 of the present invention.

FIG. 11 is a block diagram of a control system for a tandem rolling mill according to Embodiment 4 of the present invention. In the figure, the same symbols as those in FIG. 5 denote the same portions, and description thereof is omitted. The constitution of the tandem rolling mill 1 is the same as in Embodiment 1, as shown in FIG. 11. Numeral 110 denotes a control system, 121 denotes a low-speed arithmetic unit, 122 denotes a high-speed arithmetic unit, and 123 denotes a tension proportional controller. This Embodiment 4 has such a constitution that the arithmetic operation conducted by the tension proportional controller 11 in the low-speed arithmetic unit 4 in Embodiment 1 is changed to be performed by a high-speed sampling process.

Next, action or operation of Embodiment 4 will be described.

First, action of the low-speed arithmetic unit 121 will be described. The low-speed arithmetic unit 121 is supplied with a tension command σr, angle command θr, tension σ and looper angle θ, in the same manner as the low-speed arithmetic unit 4 in Embodiment 1. By the same arithmetic operations as in Embodiment 1, the low-speed arithmetic unit 121 outputs a feed-forward torque qs and a looper speed command ωr, and inputs them to the looper speed controller 9. The low-speed arithmetic unit 121 outputs directly the output of the looper angle controller 6 that performs the same action as in Embodiment 1.

The high-speed arithmetic unit 122 is supplied with the tension command σr, the tension σ, and the output of the looper angle controller 6 calculated by the low-speed arithmetic unit 121. Inside the high-speed arithmetic unit 122, the tension proportional controller 123 outputs a signal obtained by multiplying a tension deviation σe which is the deviation between the tension command σr and the tension σ by a tension proportional gain Cvσ, whereas the high-speed arithmetic unit 122 outputs the sum, as a looper speed command vr, of the output of the looper angle controller 6 and a signal obtained by multiplying the output of the tension proportional controller 123 by −1, and inputs the looper speed command vr to the mill speed controller 2. Here, the high-speed arithmetic unit 122 performs arithmetic operations with a sampling period at a higher speed than that in the low-speed arithmetic unit 121. The realization of the high-speed arithmetic unit 122 may be done by using the same computer as the low-speed arithmetic unit 121 and performing arithmetic operations with a plurality of sampling periods, or may be done by performing arithmetic operations by a computer different from the low-speed arithmetic unit 121.

With the above actions of Embodiment 4, the same arithmetic operations as in Embodiment 1 are carried out as viewed on a continuous time system basis, so that the characteristic polynomial of the closed loop system is represented by the same Eqs. (10) to (14) as in Embodiment 1. As mentioned in the description of Embodiment 1, the proportional gain Cqω of the looper speed proportional controller 10 in the looper speed controller 9 and the proportional gain Cvσ of the tension proportional controller 123 change the coefficient of the cube of s in the characteristic polynomial of Eq. (10). This control loop corresponds to the innermost control loop in the control system, and is required to have the fastest response in order to stably enhance the speed of response of the entire control system. Therefore, while only the arithmetic operation in the looper speed controller 9 is carried out with a high-speed sampling period in Embodiment 1, when the arithmetic operation of the tension proportional controller 123 is carried out in the high-speed arithmetic unit 122 with a sampling period at higher speed than the low-speed arithmetic unit 121 as in this Embodiment 4, the response of the entire control system can be realized at a much higher speed than in Embodiment 1.

Since Embodiment 4 displays the above actions, the response of the control system at a much higher speed than Embodiment 1 can be realized with simple adjustments of the control system in the same manner as in Embodiment 1, and tension control with a further higher accuracy can be realized.

Embodiment 5

Figure 12:
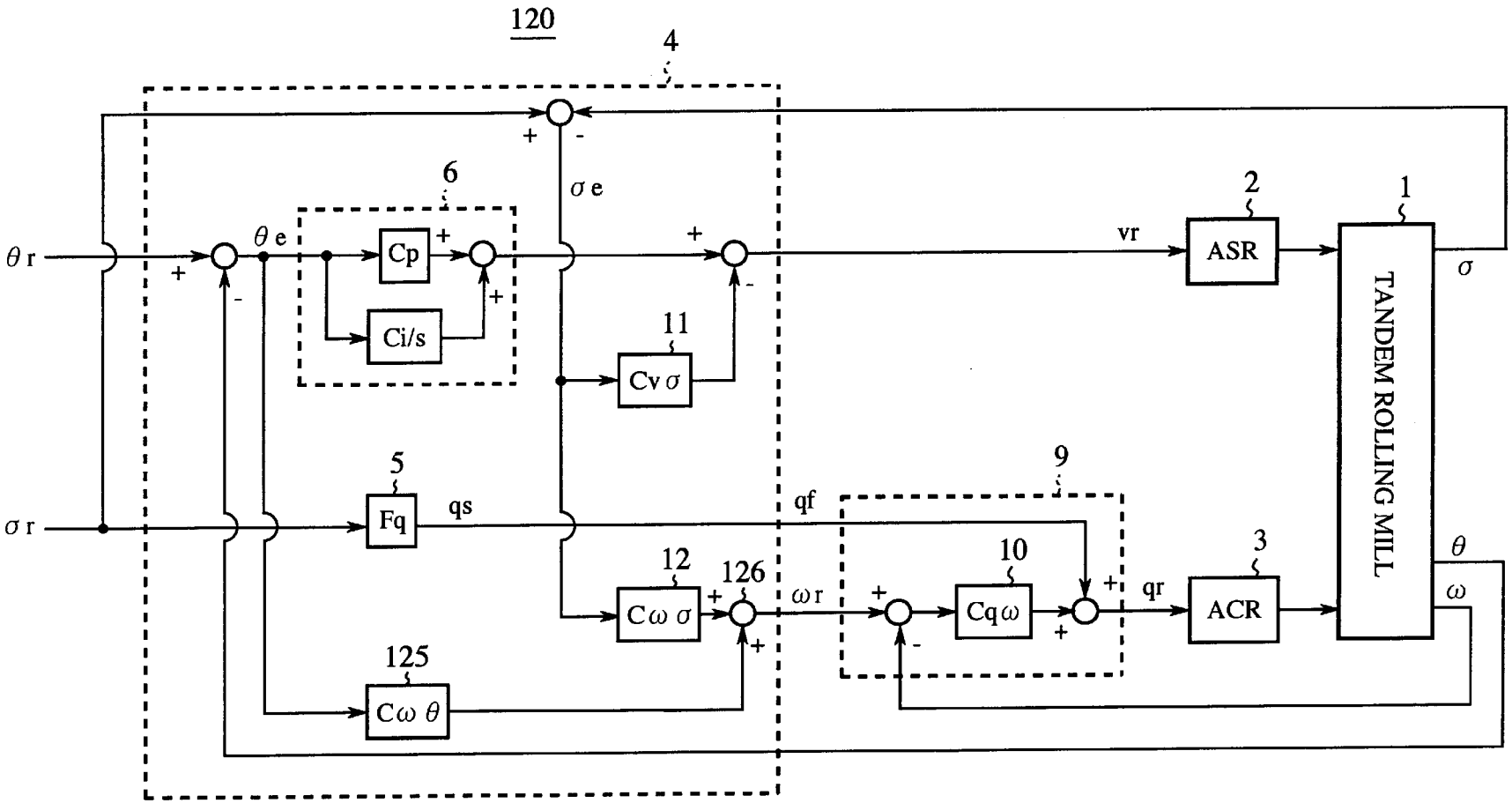
FIG. 12 is a block diagram of a control system for a tandem rolling mill according to Embodiment 5 of the present invention.

FIG. 12 is a block diagram of a control system for a tandem rolling mill according to Embodiment 5 of the present invention. In the figure, the same symbols as those in FIG. 5 denote the same portions, and description thereof is omitted. The constitution of the tandem rolling mill 1 is the same as in Embodiment 1, as shown in FIG. 1. Numeral 120 denotes a control system, 125 denotes a looper angle proportional controller for multiplying a looper angle deviation θe which is an input to a looper angle controller 6 by a gain Cωθ, and 126 denotes an adder for adding the output of the looper angle proportional controller 125 to the output of a tension intersection proportional controller 12 and inputs the result as a looper speed command ωr to a looper speed controller 9.

Now, action or operation of Embodiment 5 will be described.

The looper angle proportional controller 125 inputs a signal Cωθ·θe obtained by multiplying the looper angle deviation θe by a gain Cωθ to the adder 126. The adder 126 adds the signal Cωθ·θe from the looper angle proportional controller 125 to the output Cωσ·σe of the tension intersection proportional controller 12, and inputs the sum signal Cωθ·θe+Cωσ·σe as a looper speed command ωr to the looper speed controller 9. Therefore, a looper torque command qr outputted from the looper speed controller 9 becomes:

$$qr=qs+Cq\omega(C\omega\theta\cdot\theta e+C\omega\sigma\cdot\sigma e-\omega) \tag{20}$$

As seen from the equation, a signal component obtained by proportionally multiplying the looper angle deviation θe is added to the looper torque command qr, whereby such a control as to prevent the tension deviation σe from swinging to the positive side under the simulation conditions shown in FIG. 8, for example, can be performed by only appropriately setting the gain Cωθ of the looper angle proportional controller 125, though labor such as gain adjustment of the looper angle proportional controller 125 is increased.

In concrete, where the gain Cωθ of the looper angle proportional controller 125 is excessively large, movement of the looper angle θ in response to variations in the tension σ is excessively suppressed and the tension control accuracy is deteriorated; however, where the gain Cωθ is set at a small appropriate value, the gain Cωθ affects the looper torque command qr even if the tension deviation σe remains at 0, and the looper angle deviation θe can be converged to 0. As a result, a control of a transient variation suppression type in which the tension deviation se is settled without swinging to the positive side can be realized, as contrasted to the transient response waveform of FIG. 8 shown in Embodiment 1 in which the response of the tension deviation σe is once largely swung to the negative side and then minutely swung to the positive side whereby the looper angle deviation θe is converted to 0.

As described above, in this Embodiment 5, tension control accuracy can be improved by setting of the gain of the proportional controller 125. In addition, since a signal component obtained by integrating the looper angle deviation θe is not added, the steady value of the tension G necessarily affects the steady value of the looper angle θ in the same manner as before. In addition, since the steady value of the looper angle θ and the steady value of the tension u are not separately controlled, tension control accuracy can be enhanced by a simple adjustment of adding one by one a plurality of proportional control loops to a one-loop control system, in a supplementary manner, based on the looper angle controller 6.

Embodiment 6

Figure 13:
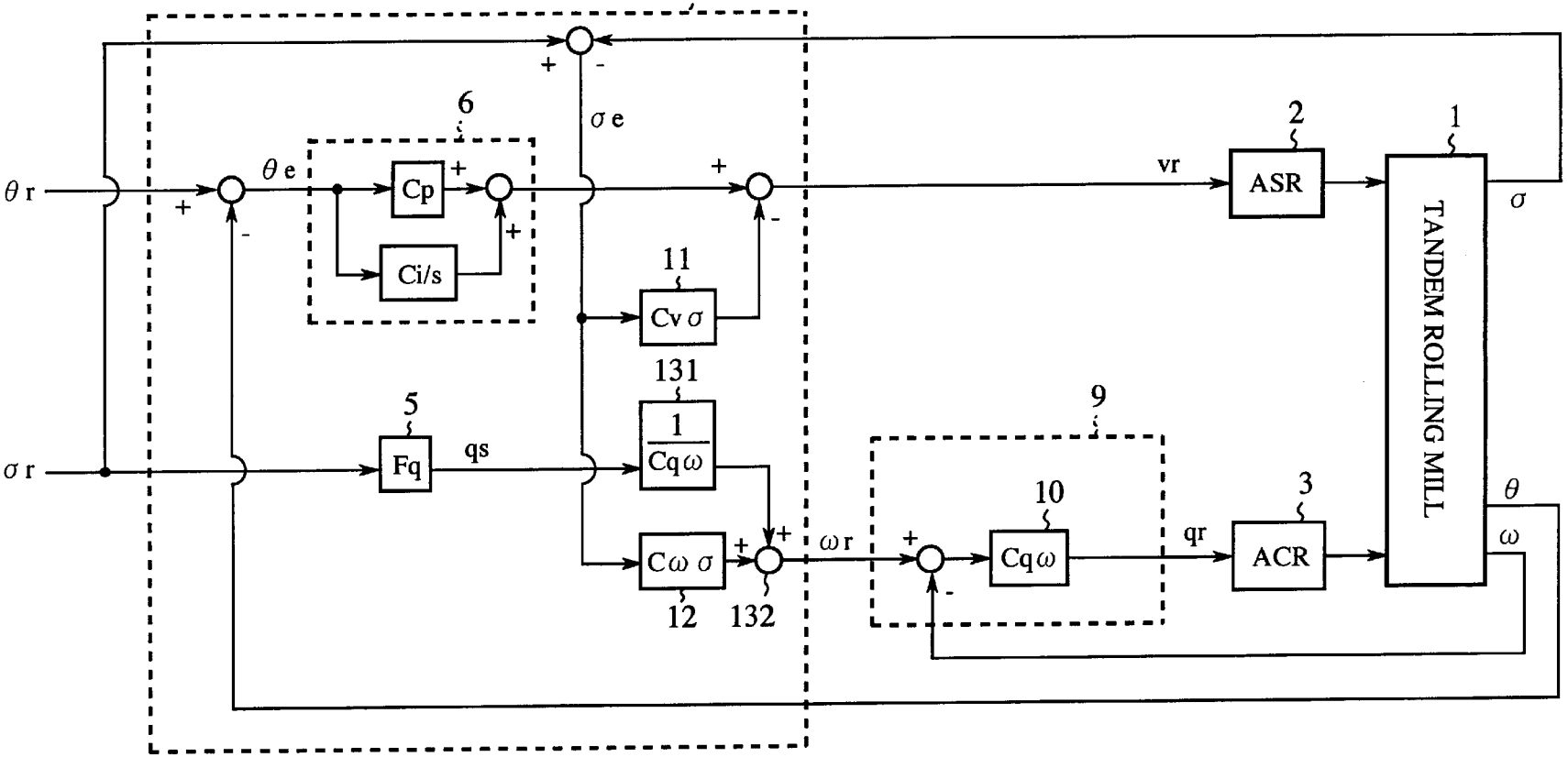
FIG. 13 is a block diagram of a control system for a tandem rolling mill according to Embodiment 6 of the present invention.

FIG. 13 is a block diagram of a control system for a tandem rolling mill according to Embodiment 6 of the present invention. In the figure, the same symbols as those in FIG. 5 denote the same portions, and description thereof is omitted. The tandem rolling mill 1 is the same as in Embodiment 1, and the constitution thereof is as shown in FIG. 1. Numeral 130 denotes a control system, 131 denotes a multiplier for multiplying a tension setting torque qs outputted from a tension setting torque arithmetic unit 5 by the reciprocal 1/Cqω of a gain Cqω of a looper speed proportional controller 10, and 132 denotes an adder for adding the output of the multiplier 131 to the output of a tension intersection proportional controller 12 and inputting the sum as a looper speed command ωr to a looper speed controller 9. In Embodiment 6, the adder which has been provided at the output stage of the looper speed controller 6 is eliminated, and the output of the looper speed proportional controller 10 is directly supplied to a looper torque controller 3.

Next, action or operation of Embodiment 6 will be described.

The tension setting torque qs outputted by the tension setting torque arithmetic unit 5 is multiplied in the multiplier 131 by the reciprocal 1/Cqω of the gain Cqω of the looper speed proportional controller 10, and the product is inputted to the adder 132. The adder 132 adds the output of the multiplier 131 to the output of the tension intersection proportional controller 12, and the sum is inputted to the looper speed controller 9 as a looper speed command ωr. The tension setting torque qs multiplied by the reciprocal 1/Cqω of the gain Cqω in the multiplier 131 is multiplied by the gain Cqω by the looper speed proportional controller 10 in the looper speed controller 9, so that, after all, the result is equivalent to the case of adding with a gain of 1 at the latter stage of the looper speed proportional controller 10, in the same manner as in Embodiment 1.

As described above, in this Embodiment 6, the looper speed controller 9 performs only a proportional control, so that the variation of looper angle θ is not excessively suppressed, and since the looper speed controller 9 does not perform an arithmetic operation on a time function, it is easy to externally set a steady looper torque command qr. Here, the control system 130 must add in a low-speed arithmetic unit 4 a signal obtained by dividing the tension setting torque qs by the looper speed proportional gain Cq ω and the output of the tension intersection proportional controller 12, so that the complicatedness of arithmetic operations in the low-speed arithmetic unit 4 is increased. However, the looper speed command containing the value obtained by dividing the tension command qs by the looper speed gain Cqω is given on the former stage side of the looper speed controller 9, whereby, the looper speed gain Cqω and its reciprocal 1/Cqω substantially cancel each other. As a result, the tension command with a gain of 1 is added to the output of the looper speed proportional controller 10, which contributes to enhancement of processing speed of the looper speed controller 9 in which one addition processing action is omitted. Incidentally, the looper speed command ωr and the looper speed ω steadily take different values, so that the actions of the control system are difficult to intuitively grasp, which should be somewhat negatively evaluated.

Embodiment 7

Figure 14:
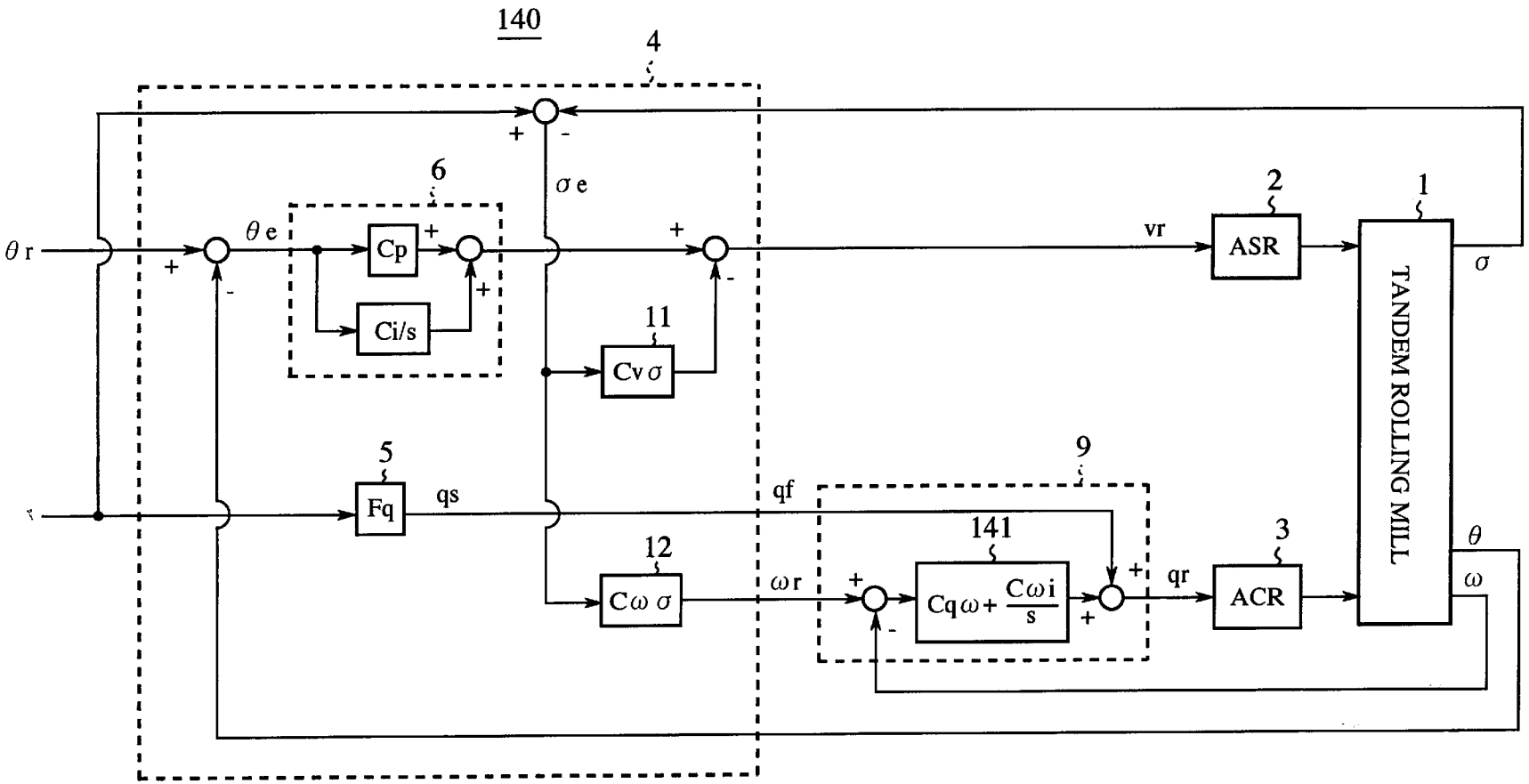
FIG. 14 is a block diagram of a control system for a tandem rolling mill according to Embodiment 7 of the present invention.

FIG. 14 is a block diagram of a control system for a tandem rolling mill according to Embodiment 7 of the present invention. In the figure, the same symbols as those in FIG. 5 denote the same portions, and description thereof is omitted. The tandem rolling mill 1 is the same as in Embodiment 1, and the constitution thereof is as shown in FIG. 1. Numeral 140 denotes a control system, and 141 denotes a looper speed proportional-integral controller for performing a PI (proportional-integral) action. This Embodiment 7 is characterized in that the looper speed proportional controller 10 shown in Embodiment 1 is replaced with the looper speed proportional-integral controller 141.

Next, action or operation of Embodiment 7 will be described.

The looper speed proportional-integral controller 141 in a looper speed controller 9 has a proportional gain Cqω and an integral gain Cωi, performs a PI (proportional-integral) arithmetic operation on the deviation between a looper speed command &r outputted by a tension intersection proportional controller 12 and looper speed ω, and outputs the sum signal of the result of the arithmetic operation and a feed-forward torque qf as a looper torque command qr. Namely, $$qr = \{Cq\omega + (C\omega i/s)\}(\omega r - \omega) + qf \tag{21}$$

$$= Cq\omega(\omega r - \omega) + C\omega i/s(\omega r - \omega) + qf$$

$$= Cq\omega(C\omega\sigma \cdot \sigma e - \omega) + C\omega i/s(C\omega\sigma \cdot \sigma e - \omega) + qf$$

Therefore, the looper torque command qr contains a signal component obtained by a proportional-integral arithmetic operation on the looper speed ω; however, the time integrated value of the looper speedω. That is, ω/s is the looper angle θ. Consequently, the looper torque command qr cannot contain a value obtained by integrating the looper angle deviation θe.

As described above, in this Embodiment 7, the same effect as Embodiment 5 is obtained where the integral gain Cωi is small. In addition, by the effects of the tension intersection proportional controller 12 and the integral action of the looper speed controller 9, the looper torque command qr contains a value obtained by integrating the tension deviation σe, so that a steady value of the looper torque command qr is set at such a value as not to generate a steady deviation of tension σ, in the same manner as in Embodiment 5. Here, when the integral gain Cωi of the looper speed controller 9 is set to be excessively large, a bad effect of excessively suppressing the variations in the looper angle θ may be exerted on the control system. Besides, both a gain for adding a component obtained by integrating the tension deviation σe to the looper torque command qr and a gain for adding a signal obtained by proportionally multiplying the integration of the looper speed ω, namely, the looper angle θ to the looper torque command qr are set by the integral gain Cωi of the looper speed controller 9, so that there is the problem that an optimum gain setting is difficult, which should be understood.

INDUSTRIAL APPLICABILITY

As described above, the control system for tandem rolling mill according to the present invention is suitable for a rolling equipment in which good quality and stable operation are contrived by good control of both the material tension of the rolling material and looper angle.

What is claimed is:

1. A control system for a tandem rolling mill for continuously rolling a rolling material by bringing a looper, driven by a looper motor, into contact with the rolling material drivingly fed by a mill motor to restrict feeding shape of the rolling material, including:

a looper torque controller responding to a torque command for controlling the torque of the looper motor; and a mill speed controller responding to a mill speed command for controlling speed of the mill motor;

a looper angle controller for controlling arithmetic operation on a looper angle deviation, which is a deviation of looper angle from an externally input looper angle command, and providing results of the arithmetic operation on the looper angle deviation to said mill speed controller as a mill speed command; and a looper speed controller operating at an arithmetic operation speed higher than that of said looper angle controller, for controlling an arithmetic operation on a looper speed deviation, which is a deviation of looper speed from an externally input looper speed command, and providing results of the arithmetic operation on the looper speed deviation to said looper torque controller as a torque command unrelated to results of said looper angle controller.

2. The control system for a tandem rolling mill as set forth in claim 1, wherein said looper speed controller comprises a looper speed proportional controller for proportionally multiplying the looper speed deviation to produce a product and adding the product to a looper torque command calculated based on a tension command, which is a tension target value for the rolling material.

3. The control system for a tandem rolling mill as set forth in claim 1, further comprising a tension intersection proportional controller for proportionally multiplying a tension deviation, which is a deviation of tension from a tension command, to produce a product as the looper speed command.

4. The control system for a tandem rolling mill as set forth in claim 1, further comprising a tension proportional controller for proportionally multiplying a tension deviation, which is a deviation of tension from a tension command, to produce a product, and causing the product to be a subtraction input for the mill speed command.

5. The control system for a tandem rolling mill as set forth in claim 4, wherein said tension proportional controller comprises a computer operating at an arithmetic operation speed higher than that of said looper angle controller.

6. The control system for a tandem rolling mill as set forth in claim 1, further comprising a tension integral controller for performing an integrating arithmetic operation on a tension deviation, which is a deviation of tension from a tension command, and adding results of the arithmetic operation to a tension setting torque.

7. The control system for a tandem rolling mill as set forth in claim 1, wherein the looper speed command externally input to said looper speed controller is fixed at zero, and a value obtained by multiplying the looper speed by a negative constant is set as a torque command in the looper torque controller.

8. The control system for a tandem rolling mill as set forth in claim 1, further comprising a looper speed intersection proportional controller for proportionally multiplying the looper speed to produce a product, and causing the product to be a subtraction input for the mill speed command.

9. The control system for a tandem rolling mill as set forth in claim 1, further comprising a looper angle proportional controller for proportionally multiplying the looper angle deviation, which is an input to said looper angle controller, to produce a product, and adding the product to the looper speed command, which is an input to said looper speed controller.

10. The control system for a tandem rolling mill as set forth in claim 1, wherein said looper speed controller comprises a looper speed proportional controller for proportionally multiplying the looper speed deviation by a looper speed gain, and said looper speed proportional controller is given a looper speed command, including a value obtained by dividing by the looper speed gain a tension setting torque calculated based on a tension command, which is a tension target value for the rolling material.

11. The control system for a tandem rolling mill as set forth in claim 1, wherein said looper speed controller comprises a looper speed proportional-plus-integral controller for performing a proportional-plus-integral arithmetic operation on the looper speed deviation, and adding results of the arithmetic operation on the looper speed deviation to a looper torque command calculated based on a tension command, which is a tension target value for the rolling material.

* * * * *